US012188323B2

(12) United States Patent
Owoeye et al.

(10) Patent No.: US 12,188,323 B2
(45) Date of Patent: Jan. 7, 2025

(54) CONTROLLING A SUBSEA BLOWOUT PREVENTER STACK

(71) Applicant: Saudi Arabian Oil Company, Dhahran (SA)

(72) Inventors: Oladele Owoeye, Dhahran (SA); Peter Ido Egbe, Abqaiq (SA)

(73) Assignee: Saudi Arabian Oil Company, Dhahran (SA)

( * ) Notice: Subject to any disclaimer, the term of this patent is extended or adjusted under 35 U.S.C. 154(b) by 42 days.

(21) Appl. No.: 18/075,067

(22) Filed: Dec. 5, 2022

(65) Prior Publication Data

US 2024/0183243 A1 Jun. 6, 2024

(51) Int. Cl.
*E21B 33/06* (2006.01)
*E21B 33/064* (2006.01)
*E21B 47/10* (2012.01)

(52) U.S. Cl.
CPC ..... *E21B 33/064* (2013.01); *E21B 33/063* (2013.01); *E21B 47/10* (2013.01)

(58) Field of Classification Search
CPC ..... E21B 33/063; E21B 33/064; E21B 47/10
See application file for complete search history.

(56) References Cited

U.S. PATENT DOCUMENTS 1,548,543 A 8/1925 Moody
2,014,563 A 9/1935 Halliburton
2,058,688 A 10/1936 Halliburton
2,173,037 A 9/1939 Dailey
2,180,589 A 11/1939 Hodges
2,694,450 A 11/1954 Osbun
2,754,136 A 7/1956 Newton
2,801,715 A 8/1957 Hall
(Continued)

FOREIGN PATENT DOCUMENTS

AU 1977028454 3/1979
AU 2011222568 9/2011
(Continued)

OTHER PUBLICATIONS

"Bladed Drilling Reamer," Paradigm Drilling Services Ltd., 2016, 3 pages.

(Continued)

*Primary Examiner* — Matthew R Buck
(74) *Attorney, Agent, or Firm* — Fish & Richardson P.C.

(57) ABSTRACT

A system and a method for controlling a subsea blowout preventer stack with a subsea well control system having sensors and a well control programmable logic controller. The sensors are coupled to the subsea blowout preventer stack and a subsea blowout preventer control system. The subsea blowout preventer control system operates the subsea blowout preventer stack. The sensors sense a condition of the subsea blowout preventer stack and the subsea blowout preventer control system and transmit a signal representing a value of the condition to the well control programmable logic controller. The well control programmable logic controller receives the signal from the sensors, compares the value to a preset value, and in response to the value greater than or equal to the preset value, and transmits a command signal to the subsea blowout preventer control system to seal a fluid flow through the subsea blowout preventer stack.

23 Claims, 5 Drawing Sheets

(56) References Cited

U.S. PATENT DOCUMENTS

| | | | | |
|---|---|---|---|---|
| 2,865,605 | A | 12/1958 | Chadderdon | |
| 3,011,571 | A | 12/1961 | De Bree et al. | |
| 3,457,605 | A | 7/1969 | Kingsbury et al. | |
| 3,690,163 | A | 9/1972 | Shannon et al. | |
| 4,185,704 | A | 1/1980 | Nixon, Jr. | |
| 4,262,760 | A | 4/1981 | Allison et al. | |
| 4,440,019 | A | 4/1984 | Marshall | |
| 4,441,556 | A | 4/1984 | Powers et al. | |
| 4,494,618 | A | 1/1985 | Radtke | |
| 4,771,832 | A | 9/1988 | Bridges | |
| 4,880,025 | A | 11/1989 | McMahan, Jr. et al. | |
| 4,958,692 | A | 9/1990 | Anderson | |
| 4,991,668 | A | 2/1991 | Rehm et al. | |
| 5,314,015 | A | 5/1994 | Streich et al. | |
| 5,439,064 | A | 8/1995 | Patton | |
| 5,522,467 | A | 6/1996 | Stevens | |
| 5,692,563 | A | 12/1997 | Krueger | |
| 5,715,898 | A | 2/1998 | Anderson | |
| 6,269,878 | B1 | 8/2001 | Wyatt et al. | |
| 6,318,458 | B1 | 11/2001 | Rainey | |
| 6,427,530 | B1 | 8/2002 | Krueger et al. | |
| 6,578,638 | B2 | 6/2003 | Guillory et al. | |
| 6,585,045 | B2 | 7/2003 | Lee et al. | |
| 6,679,336 | B2 | 1/2004 | Musselwhite et al. | |
| 6,712,145 | B2 | 3/2004 | Allamon | |
| 6,820,702 | B2 | 11/2004 | Niedermayr et al. | |
| 7,108,080 | B2 | 9/2006 | Tessari et al. | |
| 7,389,183 | B2 | 6/2008 | Gray | |
| 7,389,828 | B2 | 6/2008 | Ritter et al. | |
| 7,419,008 | B2 | 9/2008 | Campisi et al. | |
| 7,581,595 | B2 | 9/2009 | Fay et al. | |
| 7,640,984 | B2 | 1/2010 | Vert et al. | |
| 7,717,179 | B2 | 5/2010 | Rayssiguier et al. | |
| 7,757,784 | B2 | 7/2010 | Fincher et al. | |
| 7,854,268 | B2 | 12/2010 | Lehr et al. | |
| 7,874,352 | B2 | 1/2011 | Odell et al. | |
| 7,946,356 | B2 | 5/2011 | Koederitz et al. | |
| 8,210,283 | B1 | 7/2012 | Benson et al. | |
| 8,297,359 | B2 | 10/2012 | McKay et al. | |
| 8,307,889 | B2 | 11/2012 | Lewkoski | |
| 8,356,675 | B2 | 1/2013 | Pietras et al. | |
| 8,511,388 | B2 | 8/2013 | Milne | |
| 8,517,111 | B2 | 8/2013 | Mix et al. | |
| 8,757,294 | B2 | 6/2014 | Johnson et al. | |
| 8,781,743 | B2 | 7/2014 | McKay et al. | |
| 8,789,582 | B2 | 7/2014 | Rondeau et al. | |
| 8,851,205 | B1 | 10/2014 | Short, Jr. et al. | |
| 9,016,381 | B2 * | 4/2015 | Dietz | E21B 21/08 166/344 |
| 9,085,948 | B2 | 7/2015 | Egeland | |
| 9,303,482 | B2 | 4/2016 | Hall et al. | |
| 9,404,322 | B2 | 8/2016 | Wiedecke et al. | |
| 9,759,033 | B2 | 9/2017 | Meraz et al. | |
| 9,790,749 | B2 | 10/2017 | Chen | |
| 9,879,523 | B2 | 1/2018 | Brown-Kerr et al. | |
| 9,879,526 | B2 * | 1/2018 | Jaffrey | E21B 47/12 |
| 9,970,258 | B2 | 5/2018 | Barannikow et al. | |
| 10,145,198 | B2 * | 12/2018 | Papadimitriou | E21B 33/06 |
| 10,323,464 | B1 | 6/2019 | Al-AbdulJabbar | |
| 10,337,250 | B2 | 7/2019 | Turner | |
| 10,436,010 | B2 | 10/2019 | Wesley et al. | |
| 10,669,810 | B2 | 6/2020 | Egbe et al. | |
| 10,767,438 | B2 * | 9/2020 | Papadimitriou | E21B 33/064 |
| 10,781,639 | B1 | 9/2020 | Egbe et al. | |
| 10,914,662 | B2 | 2/2021 | Gustafson | |
| 10,934,782 | B2 | 3/2021 | Egbe et al. | |
| 11,053,765 | B2 * | 7/2021 | Luca | E21B 33/064 |
| 11,499,388 | B2 * | 11/2022 | Papadimitriou | E21B 21/001 |
| 2002/0020526 | A1 | 2/2002 | Male | |
| 2009/0032241 | A1 | 2/2009 | Allen et al. | |
| 2009/0145666 | A1 | 6/2009 | Radford | |
| 2009/0183875 | A1 | 7/2009 | Rayssiguier et al. | |
| 2009/0272542 | A1 | 11/2009 | Begnaud et al. | |
| 2009/0283322 | A1 | 11/2009 | Dove | |
| 2011/0162844 | A1 | 7/2011 | Mauth | |
| 2011/0226486 | A1 | 9/2011 | Haugen | |
| 2012/0111572 | A1 | 5/2012 | Cargol, Jr. | |
| 2012/0192640 | A1 | 8/2012 | Minh et al. | |
| 2012/0279784 | A1 | 11/2012 | Harvey et al. | |
| 2013/0126153 | A1 | 5/2013 | Baker | |
| 2013/0153241 | A1 | 6/2013 | Mallinson et al. | |
| 2013/0153297 | A1 | 6/2013 | Abney et al. | |
| 2013/0319684 | A1 | 12/2013 | Moellendick | |
| 2014/0116686 | A1 | 5/2014 | Odell et al. | |
| 2014/0246197 | A1 | 9/2014 | Smith et al. | |
| 2014/0262216 | A1 | 9/2014 | Perry | |
| 2014/0343694 | A1 | 11/2014 | Aldred et al. | |
| 2015/0240585 | A1 | 8/2015 | Mancuso et al. | |
| 2015/0361731 | A1 | 12/2015 | Wood | |
| 2016/0076361 | A1 | 3/2016 | Wong et al. | |
| 2016/0305230 | A1 | 10/2016 | Benson et al. | |
| 2017/0009539 | A1 | 1/2017 | Helvenston et al. | |
| 2017/0089163 | A1 * | 3/2017 | Vitou | E21B 47/095 |
| 2018/0187498 | A1 | 7/2018 | Sanchez Soto et al. | |
| 2019/0017344 | A1 | 1/2019 | Lambert et al. | |
| 2019/0040738 | A1 | 2/2019 | Ramjit et al. | |
| 2019/0257161 | A1 | 8/2019 | Dewald et al. | |
| 2019/0368299 | A1 | 12/2019 | Jorud | |
| 2020/0056446 | A1 | 2/2020 | Al-Mousa et al. | |
| 2021/0032942 | A1 | 2/2021 | Gordon | |
| 2023/0127022 | A1 | 4/2023 | Egbe et al. | |

FOREIGN PATENT DOCUMENTS

| | | |
|---|---|---|
| CA | 2462154 | 9/2005 |
| CA | 2852765 | 5/2013 |
| CN | 103789708 | 5/2014 |
| CN | 104563872 | 4/2015 |
| EA | 015030 | 12/2009 |
| EP | 0107630 | 9/1983 |
| EP | 2594731 | 5/2013 |
| EP | 2835493 | 2/2015 |
| GB | 2568224 | 5/2019 |
| RU | 2603735 | 7/2015 |
| WO | WO 1995017580 | 6/1995 |
| WO | WO 2012161661 | 11/2012 |
| WO | WO 2013142950 | 10/2013 |
| WO | WO 2014182303 | 11/2014 |
| WO | WO 2015199986 | 12/2015 |
| WO | WO 2016034945 | 3/2016 |
| WO | WO 2019050810 | 3/2019 |
| WO | WO 2022173914 | 8/2023 |

OTHER PUBLICATIONS

"GunDRILL Reamer (GDR)," Rubicon Oilfield International, available on or before Mar. 24, 2020, 1 page.

Aldred et al., "Managing Drilling Risk," Oilfield Review, Summer 1999, 18 pages.

Amaya et al., "Effect of Chromium and Molybdenum on Corrosion Resistance of Super 13CR Martensitic Stainless Steel in CO2 Environment," NACE International, Corrosion, Mar. 22-27, 1998, 98:113, 16 pages.

jfe-steel.co.jp [online], "WetCo2 Service," 203-2021, retrieved on Apr. 2, 2021, retrieved from URL <https://www.jfe-steel.co.jp/en/products/energy/octg/material/13cr_hp.html>, 4 pages.

neonalloys.com [online], "Alloy Super 131CR/UNS S41427," 2016, retrieved on Apr. 2, 2021, retrieved from URL <https://www.neonalloys.com/alloy-super-13cr-uns-s41427.php>, 2 pages.

slb.com [online], "Diamond-Enhances Insert Stabilizer," Schlumberger, available on or before Jul. 9, 2020, retrieved from URL <https://www.slb.com/drilling/bottomhole-assemblies/reamers-and-stabilizers/diamond-enhanced-stabilizer>, 3 pages.

* cited by examiner

CONTROLLING A SUBSEA BLOWOUT PREVENTER STACK

TECHNICAL FIELD

This disclosure relates to controlling a subsea blowout preventer stack, in particular, by a programmable logic controller responsive to conditions of the subsea blowout preventer stack.

BACKGROUND

Wellbores in an oil and gas well conduct liquid and gaseous phases of various fluids and chemicals including water, oils, and hydrocarbon gases from subterranean formations to a surface of the Earth. Some wellbores can be under a body of water, i.e., a subsea well. The fluids and gases in the subsea wellbore can be pressurized. A subsea well control system is installed on the subsea wellbore to seal the wellbore and to control the flow of oil and gas from the subsea wellbore.

SUMMARY

This disclosure describes methods and systems related to controlling a subsea blowout preventer stack, for instance, with a well control programmable logic controller, responsive to conditions of the subsea blowout preventer system. In these systems and methods, the well control programmable logic controller receives signals representing conditions of the subsea blowout preventer stack for sensors and based on the conditions, transmits a command signal via a subsea blowout preventer control system to seal the subsea blowout preventer stack.

In one aspect, a subsea well control system includes multiple sensors and a well control programmable logic controller. The sensors are coupled to a subsea blowout preventer stack and a subsea blowout preventer control system. The subsea blowout preventer control system is operatively coupled to the subsea blowout preventer stack. The sensors sense a condition of the subsea blowout preventer stack and the subsea blowout preventer control system and transmit a signal representing a value of the condition to the well control programmable logic controller. The condition includes at least one of a temperature, a pressure, a fluid type of a fluid in the subsea blowout preventer stack, a specific gravity of the fluid, a flow rate of the fluid, a presence of a tool joint of a work string, a location of annular preventers, a location of rams, a position of the annular preventers, a position of the rams, a wear measurement of the annular preventers, a wear measurement of the rams, a closure blockage of at least one of the annular preventers or the rams, or a pressure of the subsea blowout preventer control system. The well control programmable logic controller is operatively coupled to the subsea blowout preventer control system to perform operations including receiving the signal from the sensors, comparing the value to a preset value, and in response to the value greater than or equal to the preset value, transmitting a command signal to the subsea blowout preventer control system to seal, by at least one of the annular preventers and the rams of the subsea blowout preventer stack, a fluid flow through the subsea blowout preventer stack.

In some implementations, rams include one or more of a pipe ram, a variable ram, a shear ram, a blind shear ram, or a casing ram. In some cases, the position of the rams includes and open position and a closed position. The open position permits the work string to pass through the subsea blowout preventer stack. The closed position seals the subsea blowout preventer stack. Moving from the open position to the closed position with the work string positioned in the subsea blowout preventer stack shears the work string.

In some implementations, sealing the fluid flow through the subsea blowout preventer stack includes activating at least one ram of the rams to seal the subsea blowout preventer stack; after activating the at least one ram of the rams, waiting a predetermined delay time; and after waiting the predetermined delay time, activating another of the rams or the annular preventers to further seal the subsea blowout preventer stack. In some cases, the predetermined delay time is twice a response time required to seal the subsea blowout preventer stack. In some cases, the predetermine delay time is twice a response time required to activate the at least one ram of the plurality of rams. In some cases, sealing the fluid flow through the subsea blowout preventer stack includes monitoring i) a shearing pressure of the at least one ram of the rams, ii) a fluid volume required to shear the work string by the at least one ram of the rams, and iii) a position of a shear ram piston of the at least one ram of the rams; comparing the shearing pressure to a calculated shear pressure for the work string, where the shearing pressure is greater than or equal to the calculated shear pressure indicates proper operation of the at least one ram of the rams; comparing the fluid volume required to shear the work string to a calculated fluid volume required to shear the work string, where the fluid volume required to shear the work string is greater than or equal to the calculated fluid volume indicates proper operation of the at least one ram; detecting the position of the shear ram piston at a full stroke position indicating a full tubular shear of the work string; in response to i) the shearing pressure greater than or equal to the calculated shear pressure, ii) the fluid volume required to shear the work string greater than or equal to the calculated fluid volume, and iii) the position of the shear ram piston is at the full stroke position, waiting the predetermined delay time; and after waiting the predetermined delay time, activating the another ram to further seal the subsea blowout preventer stack.

In some implementations, at least one of the sensors is a solid state magnetic field sensor, a Hall effect sensor, a strain gauge, or a proximity sensor to sense a position of piston rods coupled to the rams.

In some implementations, the well control programmable logic controller further includes an alarm to alert an operator of the condition of the subsea blowout preventer stack. The alarm includes at least one of a sounding alarm, a flashing light, or a speed dial call to an operator.

In some implementations, the well control programmable logic controller is operatively coupled to a lower marine riser package coupled to and positioned about the subsea blowout preventer stack. The well control programmable logic controller performs operations including receiving, from multiple lower marine riser package sensors, a signal representing a value of a condition of the lower marine riser package, the condition comprising at least one of a loss of power to the lower marine riser package, a loss of signal to pilot valves of the lower marine riser package, a loss of dynamic positioning, loss of hydraulic pressure to subsea control pods, a drift off, a drive off, a collision with a supply vessel, an electronic riser angle exceeding a maximum design rating triggering the lower marine riser package to disconnect from the subsea blowout preventer stack; comparing the value to a lower marine riser package preset value; and in response to the value greater than or equal to a preset value, transmitting the command signal to the subsea blowout preventer control system to seal, by at least one of the annular preventers and the rams of the subsea blowout preventer stack, a fluid flow through the subsea blowout preventer stack.

In some cases, the lower marine riser package includes tensioners coupling the lower marine riser package to the subsea blowout preventer stack. The well control programmable logic controller adjusts a value of a tension of the tensioners within an upper tension limit and a lower tension limit.

In some cases, the lower marine riser package is coupled to a riser connected to a drill ship, the riser includes multiple flex joints including at least one of an upper flex joint or a lower flex joint and multiple flex joint sensors coupled to the flex joints. The well control programmable logic controller is operatively coupled to the flex joints. The well control programmable logic controller performs operations including receiving, from the flex joint sensors, a signal representing a value of a condition of the plurality of flex joints and a critical riser component, the condition comprising at least one of a the an electronic riser angle exceeding a maximum design rating of the riser, an angle of the riser relative to the drill ship, an angle of the riser relative to the lower marine riser drill package, and an angle of the critical riser component; comparing the value to a flex joint preset value and a critical riser component preset value; and in response to the value greater than or equal to a preset value, transmitting the command signal to the subsea blowout preventer control system to activate a disconnect of an emergency disconnect package from the lower marine riser package.

In some implementations, the well control programmable logic controller is operatively coupled to a mud system to flow a drilling mud to the subsea blowout preventer stack. The well control programmable logic controller performs operations including receiving a signal representing a value of a condition of the mud system, where the condition of the mud system includes at least one of a flow rate of the drilling mud in a surface line of the mud system, a pressure of the drilling mud in the surface line of the mud system, a level of the drilling mud in a mud pit of the mud system, a volume of drilling mud in the mud pit, a mud weight of the drilling mud, a level of drilling mud in a trip tank of the mud system, and a volume of drilling mud in the trip tank; comparing the value of the condition of the mud system to a mud system preset value; and based on the result of the comparison, in response to the value greater than or equal to a mud system preset value, transmitting the command signal to the subsea blowout preventer control system to seal, by at least one of the annular preventers and the rams of the subsea blowout preventer stack, a fluid flow through the subsea blowout preventer stack.

In some implementations, the well control programmable logic controller performs inflow test operations including reducing a pressure of the subsea well control system; monitoring a flow rate from the subsea well control system; adjusting the flow rate for temperature effects; comparing the adjusted flow rate to a zero leak rate; and based on the result of the comparison, in response to the adjusted flow rate is great than or equal to the zero leak rate, determining that an inflow condition exists.

In some implementations, the well control programmable logic controller receives command signals from and transmit status signals to an offsite real-time operations center.

In another aspect, a method includes sensing a condition of a subsea blowout preventer stack and a subsea blowout preventer control system operatively coupled to the subsea blowout preventer stack, where the condition includes at least one of a temperature, a pressure, a fluid type of a fluid in the subsea blowout preventer stack, a specific gravity of the fluid in the subsea blowout preventer stack, a flow rate in the subsea blowout preventer stack, a presence of a tool joint of a work string, a location of annular preventers, a location of rams, a position of the annular preventers, a position of the rams, a wear measurement of the annular preventers, a wear measurement of the rams, a closure blockage of at least one of the annular preventers or the rams, or a pressure of the subsea blowout preventer control system; transmitting a signal representing a value of the condition to a well control programmable logic controller operatively coupled to the subsea blowout preventer control system; receiving the signal at the well control programmable logic controller; comparing the value to a preset value; and based on the result of the comparison, in response to the value greater than or equal to a preset value, transmitting a command signal to the subsea blowout preventer control system to seal, by at least one of the annular preventers and the rams of the subsea blowout preventer stack, a fluid flow through the subsea blowout preventer stack.

In some implementations, sealing the fluid flow through the subsea blowout preventer stack includes activating at least one ram of the rams to seal the subsea blowout preventer stack; after activating the at least one ram, waiting a predetermined delay time; and after waiting the predetermined delay time, activating another of the rams or the annular preventers to further seal the subsea blowout preventer stack. In some cases, the predetermined delay time is twice a response time required to seal the subsea blowout preventer stack. In some cases, the predetermine delay time is twice a response time required to activate the at least one ram of the rams.

In some cases, sealing the fluid flow through the subsea blowout preventer stack includes monitoring i) a shearing pressure of the at least one ram, ii) a fluid volume required to shear the work string by the at least one ram, and iii) a position of a shear ram piston; comparing the shearing pressure to a calculated shear pressure for the work string, where the shearing pressure greater than or equal to the calculated shear pressure indicates proper operation of the at least one ram; comparing the fluid volume required to shear the work string to a calculated fluid volume required to shear the work string, where the fluid volume required to shear the work string greater than or equal to the calculated fluid volume indicates proper operation of the at least one ram; detecting the position of the shear ram piston at a full stroke position indicating a full tubular shear of the work string; in response to i) the shearing pressure greater than or equal to the calculated shear pressure, ii) the fluid volume required to shear the work string greater than or equal to the calculated fluid volume, and iii) the position of the shear ram piston is at the full stroke position, waiting the predetermined delay time; and after waiting the predetermined delay time, activating the another ram to further seal the subsea blowout preventer stack.

In some cases, receiving, from lower marine riser package sensors coupled to and positioned about the subsea blowout preventer stack, a signal representing a value of a condition of the lower marine riser package, the condition including at least one of a loss of power to the lower marine riser package, a loss of signal to pilot valves of the lower marine riser package, a loss of dynamic positioning, loss of hydraulic pressure to subsea control pods, a drift off, a drive off, a collision with a supply vessel, an electronic riser angle exceeding a maximum design rating triggering the lower marine riser package to disconnect from the subsea blowout preventer stack; comparing the value to a lower marine riser package preset values; and based on the result of the comparison, in response to the value greater than or equal to a preset value, transmitting the command signal to the subsea blowout preventer control system to seal, by at least one of the annular preventers and the rams of the subsea blowout preventer stack, a fluid flow through the subsea blowout preventer stack. Sometimes, adjusting a value of a tension of multiple tensioners coupling the lower marine riser package to the subsea blowout preventer stack within an upper tension limit and a lower tension limit.

In some implementations, receiving, at the well control programmable logic controller, a signal representing a value of a condition of a mud system to flow a drilling mud to the subsea blowout preventer stack, the condition of the mud system including at least one of a flow rate of the drilling mud in a surface line of the mud system, a pressure of the drilling mud in the surface line of the mud system, a level of the drilling mud in a mud pit of the mud system, a volume of drilling mud in the mud pit, a mud weight of the drilling mud, a level of drilling mud in a trip tank of the mud system, and a volume of drilling mud in the trip tank; comparing the value of the condition of the mud system to a mud system preset value; and in response to the value greater than or equal to a corresponding mud system preset value, transmitting the command signal to the subsea blowout preventer control system to seal, by at least one of the annular preventers and the rams of the subsea blowout preventer stack, a fluid flow through the subsea blowout preventer stack.

In some implementations, the method includes reducing a pressure of the subsea blowout preventer stack; monitoring a flow rate from the subsea blowout preventer stack; adjusting the flow rate for temperature effects; comparing the adjusted flow rate to a zero leak rate; and based on the result of the comparison, in response to the adjusted flow rate is great than or equal to the zero leak rate, determining that an inflow condition exists.

In some implementations, the method includes receiving, at the well control programmable logic controller, a control signal from an offsite real-time operations center; and transmitting, to the offsite real-time operations center and from the well control programmable logic controller, a status signal indicating the condition of subsea blowout preventer stack.

Implementations of the present disclosure can realize one or more of the following advantages. These systems and methods can improve personnel and environmental safety. For example, detecting a kick (a wellbore pressure surge) sooner, that is, before a pressure reaches a dangerous threshold pressure causing wellbore damage or personnel harm, the subsea blowout preventer stack can seal the subsea wellbore. For example, human error in initiating sealing the subsea wellbore can be reduced, improving personnel and environmental safety. For example, by using a delay time between actuating multiple sets of rams to seal the wellbore, proper operation of both of the rams can be improved and verified, thus improving personnel and environmental safety.

These systems and methods can improve detection of an inflow condition. For example, some inflow conditions can be masked by wellbore operations such as work string tripping, fluid transfer from an active mud tank, or vessel movement. By using the well control programmable logic controller to monitor and analyze mud system conditions, the detection of the inflow condition can be improved.

These systems and methods can improve safety by serving as a fail-safe system in the worst case of loss of well control or wellbore blow out condition. These systems and methods can shut the well in (i.e., seal the wellbore) or shear and seal the subsea wellbore with minimal or no human intervention. By using the well control programmable logic controller to monitor and analyze well conditions and compare the well conditions to preset blow out scenarios (i.e., wellbore conditions which can indicated a condition exceeding a condition threshold), the onset of loss of well control can be detected before onloading the riser volume.

These systems and methods can improve safety by identifying a breaking point or a weak point in the drilling riser system of the mobile drilling vessel under extreme condition of drift-off or drive off where the lower marine riser package (LMRP) failed to disconnect from the subsea blow out preventer.

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION

An oil and gas well has a wellbore extending from a surface of the Earth to subterranean formations in the Earth. Sometimes, the wellbore can be under a body of water, for example, a sea or ocean. Such wellbores are referred to as a subsea wellbore. The subterranean formations contain liquid and gaseous phases of various fluids and chemicals including water, oils, and hydrocarbon gases. The wellbore conducts the fluids and chemicals from the subterranean formations to the surface. A subsea blowout preventer stack coupled to the subsea wellbore has annular preventers and rams to seal a flow of the fluids from the wellbore along a work string extending through the blowout preventer stack during wellbore drilling, completion, or workover operations. Sometimes, a pressure of the fluids in the wellbore and the subsea blowout preventer stack rapidly increases (a kick or surge), and the annular preventers and rams are operated to seal about the work string or sever the work string to seal the fluids in the wellbore from the surrounding environment.

The present disclosure relates to controlling a subsea blowout preventer stack, for instance, with a well control programmable logic controller responsive to conditions of the subsea blowout preventer system. In this approach, after a condition of the subsea blowout preventer stack is greater than a preset value, the well control programmable logic controller transmits a command signal to the annular preventers and/or the rams to seal the subsea blowout preventer stack.

Figure 1A:
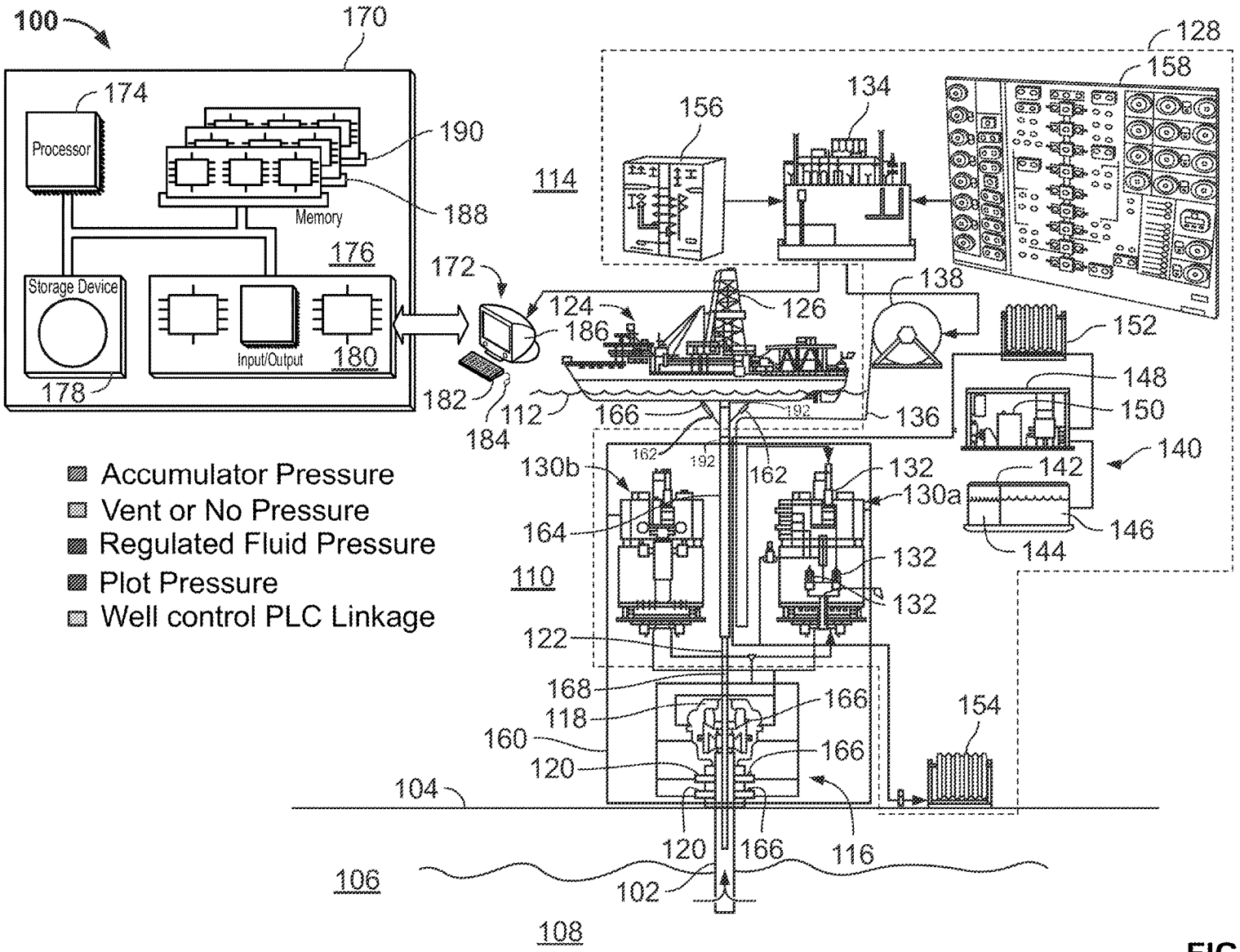
FIG. 1A shows a well system having a subsea well control system controlling a subsea blowout preventer stack.

FIG. 1A shows a well system having a subsea well control system controlling a subsea blowout preventer stack. The well system 100 has a wellbore 102 extending from a surface 104 of the Earth 106. The Earth 106 has subterranean formations 108 which can contain liquid and gaseous phases of various fluids and chemicals including water, oils, and hydrocarbon gases. The wellbore 102 receives the fluids from the subterranean formation 108 and conducts the fluids to the surface 104. A body of water 110 covers the surface 104 of the Earth 106. For example, the body of water 110 can be a sea, an ocean, or a lake. In some cases, a typical water depth can range from about 150 meters to 3500 meters. The body of water 110 has a surface 112. Above the surface 112 of the body of water 110 is an atmosphere 114.

The well system 100 has a drill ship 124 floating on the surface 112 of the body of water 110. Alternatively, the well system 100 could include a first generation to sixth generation semi-submersible rig or well intervention vessels. The drill ship 124 includes a rig 126 coupled to and extending upward from the drill ship 124. A work string 122 is suspended from the rig 126 and extends from the rig 126 through the body of water 110 and into the wellbore 102. The work string 122 can be a drill string to drill the wellbore 102, a completion tool, a completion assembly, a landing string, a casing string, or a repair tool to perform a maintenance task on the wellbore 102, a subsea test string, a tough logging condition (TLC) logging string (i.e., a wireline logging assembly on a drill pipe), or other well system 100 components.

The well system 100 has a subsea blowout preventer stack 116 coupled to the wellbore 102 at the surface 104. The subsea blowout preventer stack 116 controls the flow of fluids from the wellbore 102 to the surface 112 of the body of water 110. The work string 122 extends through the subsea blowout preventer stack 116. The subsea blowout preventer stack 116 includes one or more annular preventers 118 and one or more rams 120. The annular preventers 118 seal the fluids in the wellbore 102. The annular preventer 118 seals about the work string 122 extending through the subsea blowout preventer stack 116. The annular preventer 118 can seal against the work string 122 while the work string 122 rotates to prevent the fluid from flowing from the wellbore 102 through the subsea blowout preventer stack 116 into the body of water 110, be used in a special case of volumetric stripping with work string 122, or can be used to seal against an open hole where there is no work string 122 in the wellbore 102 during a well control event. The rams 120 can be a blind ran or a shear ram which can sever the work string 122 or sever and seal the subsea blowout preventer stack 116 to prevent the fluid from the wellbore 102 from flowing through the subsea blowout preventer stack 116 and into the body of water 110. The rams 120 can be one or more of a pipe ram, a variable ram, a shear ram, a blind shear ram, or a casing ram. The rams 120 have an open position permitting the work string 122 to pass through the subsea blowout preventer stack 116 and a closed position sealing the subsea blowout preventer stack 116. Moving from the open position to the closed position with the work string 122 positioned in the subsea blowout preventer stack 116 shears the work string 122.

The well system 100 has a riser 164 extending from the subsea blowout preventer stack 116 to the drill ship 124. The riser 164 is a hollow cylinder through which the work string 122 can pass to enter into the subsea blowout preventer stack 116 and a drilling mud can return from the wellbore 102 to the drill ship 124 (as described in more detail in reference to FIG. 1B). Each section of the riser 164 (i.e, each riser joint) can support the combined weight of the subsea blow out preventer stack 116 and a lower marine riser package 160 (described in more detail below). However, in deep-water or ultra-deep water depths or applications, the riser 164 hanging weight is reduced by the attachment of a buoyant material (not shown) to an exterior of the riser joint 164. The riser 164 systems can also include a telescopic joint (not shown) and multiple flex joints 192 in upper or lower locations with an electronic riser angle measurement system (not shown) which can be used to detect drill ship 124 offset from the riser 164 at different environmental load conditions. The flex joints 192 can articulate with drill ship 124 movement.

The well system 100 has a subsea blowout preventer control system 128 coupled to the subsea blowout preventer stack 116 and the annular preventer 118 and the rams 120. The subsea blowout preventer control system 128 operates the annular preventer 118 and the rams 120 to seal the fluids in the wellbore 102. The subsea blowout preventer control system 128 receives command signals from the drill ship 124 to operate the annular preventer 118 and the rams 120. The subsea blowout preventer control system 128 has two control pods: an active control pod 130*a* (also referred to as a blue pod) and a redundant control pod 130*b* (also referred to as a yellow control pod). The control pods 130*a*, 130*b* have a series of control valves 132 which direct hydraulic fluid to and from the annular preventer 118 and the rams 120 to operate the annular preventer 118 and the rams 120. The control pods 130*a*, 130*b* receive the command signals from the drill ship 124 and operate the control valves 132. The control pods 130*a*, 130*b* can operate one or more of the annular preventer 118 and the rams 120 at a time, that is, simultaneously or sequentially, and in any order depending on the command signal.

The subsea blowout preventer control system 128 has a central control unit 134 mounted on the drill ship 124. The central control unit 134 has various valves (such as pilot valves) and electronic control units (not shown) to receive, control, and transmit command signals to the control pods 130*a*, 130*b* via a multiplex cable 136 wrapped around and deployable from a multiplex cable reel 138 mounted on the drill ship 124. The multiplex cable 136 is coupled to the central control unit 134 and the control pods 130*a*, 130*b*. The multiplex cable 136 can transmit electronic or hydraulic control command signals. The central control unit 134 is positioned on the drill ship 124. However, in some cases, for example, in shallow water depths, rather than a multiplex cable 136, a hydraulic hose bundle (not shown) or umbilical (not shown) can be used to connect the central control unit 134 to the subsea control pods 130*a*, 130*b*.

The subsea blowout preventer control system 128 has a hydraulic fluid sub-system 140 to supply pressurized hydraulic fluid to the control pods 130*a*, 130*b*. The hydraulic fluid sub-system 140 has a blowout preventer fluid reservoir 142. The blowout preventer fluid reservoir 142 has a fluid concentrate reservoir 144 and a mixed fluid reservoir 146 fluidly coupled to the fluid concentrate reservoir 144. The fluid concentrate reservoir 144 contains a hydraulic fluid concentrate (typically in liquid form). The fluid concentrate reservoir 144 feeds the hydraulic fluid concentrate to the mixed fluid reservoir 146. The mixed fluid reservoir 146 receives the hydraulic fluid concentrate from the fluid concentrate reservoir 144 and mixes the hydraulic fluid concentrate with a liquid, for example, with water or potable water from the drill ship 124. The hydraulic fluid sub-system 140 is positioned on the drill ship 124.

The hydraulic fluid sub-system 140 has a high pressure unit 148 to increase a pressure of the hydraulic fluid. The high pressure unit 148 receives the hydraulic fluid from the blowout preventer fluid reservoir 142. The high pressure unit 148 has compressors 150 to pressurize the hydraulic fluid. The high pressure unit 148 is positioned on the drill ship 124.

The hydraulic fluid sub-system 140 has a surface accumulator 152 to store the pressurized hydraulic fluid. The surface accumulator 152 receives the pressurized hydraulic fluid from the high pressure unit 148. In response to the control valves 132 opening, the surface accumulators 152 supply the pressurized hydraulic fluid through the control pods 130*a*, 130*b* to the annular preventer 118 and/or one or more of the rams 120, depending on the control valve 132 operated, to seal the subsea blowout preventer stack 116.

The hydraulic fluid sub-system 140 has subsea accumulator 154 to store pressurized hydraulic fluid as a backup or emergency supply of pressurized hydraulic fluid for the control pods 130*a*, 130*b* to operate the annular preventer 118 and/or one or more of the rams 120 in the event of a failure of one or more components of the hydraulic fluid sub-system 140. The subsea accumulator 154 is positioned the surface 104 of the Earth 106.

The subsea blowout preventer control system 128 has a mini panel 156 and a main blowout preventer panel 158 operatively coupled to the hydraulic fluid sub-system 140 and the control pods 130*a*, 130*b* to supply pressurized hydraulic fluid through the control valves 132 in the control pods 130*a*, 130*b* to operate the annular preventer 118 and/or one or more of the rams 120. The mini panel 156 and the main blowout preventer panel 158 are positioned on the drill ship 124. The mini panel 156 and the main blowout preventer panel 158 each contain various switches and buttons to transmit the command signals to the central control unit 134 and subsequently to the control pods 130*a*, 130*b* via the multiplex cable 136 to operate the annular preventer 118 and/or one or more of the rams 120. The mini panel 156 and the main blowout preventer panel 158 have gauges and alarms which visually and audibly represent well system 100 conditions. In some cases, the alarms include the alarm a sounding alarm, a flashing light, or a speed dial call to an operator. The mini panel 156 and the main blowout preventer panel 158 can be manually operated by the operator on the drill ship 124.

The well system 100 has a lower marine riser package 160 coupled to a bottom of the riser 164 as well as connected to the subsea blowout preventer stack 116. The control pods 130*a*, 130*b* are coupled to and position within the lower marine riser package 160. The lower marine riser package 160 provides structural support and protection to the subsea blowout preventer stack 116. The lower marine riser package 160 also includes an emergency disconnect package (EDP) which provides a means to disconnect the riser system from the lower marine riser package 160 and the subsea blowout preventer stack 116 and is able to ensure that the drill ship 124, a semi-submersible (not shown), or a well intervention vessel and riser 164 system is isolated from the subsea well environment (body of water 110 is an atmosphere 114) in case of either a planned or an unplanned emergency disconnect. The unplanned emergency disconnect is not limited to a drift off, a drive off, a severe weather condition, or a loss of power. The emergency disconnect package can function and disconnect even under severe load conditions such as extreme weather conditions combined with high flex joint 192 angles. The emergency disconnect package can be function tested on a routine basis.

The well system 100 has multiple tensioners 162 which are adjustable via hydraulic pressure between an upper tension threshold limit and a lower tension threshold limit to couple the riser 164 to the drilling ship 124. The tensioners 162 maintain bolts (not shown) fastening the riser 164 to the drill ship 124 in a state of tension.

The well system 100 has multiple sensors 166 positioned through out to sense conditions of the well system 100. The sensors 166 transmit signals representing values of the conditions of the well system 100. The conditions of the well system 100 sensed by the sensors 166 can include one or more of a temperature, a pressure, a fluid type of a fluid in the subsea blowout preventer stack 116, a specific gravity of the fluid, a flow rate of the fluid, a position of a tool joint 168 of the work string 122 within the blow out preventer stack 116, a location of the annular preventers 118, a location of rams 120, a position of the annular preventers 118, a position of the rams 120, a wear measurement of the annular preventers 118, a wear measurement of the rams 120, a closure blockage of at least one annular preventer 118 or the rams 120, or a pressure of the subsea blowout preventer control system 128. In some cases, the sensors 166 are one or more of a solid state magnetic field sensor, a Hall effect sensor, a strain gauge, or a proximity sensor to sense a position of a piston rods which moves in response the hydraulic fluid to operate the rams 120 or the annular preventer 118. In other cases, the sensors 166 can be pressure sensor, temperature sensors, viscosity sensors, flow meters, or angle sensors which can detect an angle of the upper flex joints 192 or the lower flex joints 192.

The lower marine riser package 160 also includes sensors 166. The sensors 166 on the lower marine riser package 160 can sense the conditions of the lower marine riser package 160 including condition a loss of power to the lower marine riser package 160, a loss of signal pilot valves (not shown, which control hydraulic fluid flow) of the lower marine riser package 160, a loss of dynamic positioning, loss of hydraulic pressure to the subsea control pods 130*a*, 130*b*, an emergency disconnect signal to the emergency disconnect package, latching signals to the lower marine riser package 160 in case of reconnection, sensors on the thrusters (not shown) can detect a loss of dynamic positioning, a drift off, a drive off, a collision with a supply vessel (not shown), an electronic riser 164 angle exceeding a maximum design rating triggering the lower marine riser package 160 to disconnect from the subsea blowout preventer stack 116.

The well system 100 includes a well control programmable logic controller 170 and an input/output device 172. In some implementations, the well control programmable logic controller 170 is positioned with in the input/output device 172. In some implementations, the well control programmable logic controller 170 and the input/output device 172 are both positioned in the drill ship 124, however, in other implementations, one or both of the well control programmable logic controller 170 and the input/output device 172 are located in a offsite remote operations center (not shown) and the command signals are transmitted from the well control programmable logic controller 170 to the central control unit 134 on the drill ship 124. The well control programmable logic controller 170 is operatively coupled to the subsea blowout preventer control system 128 to control the annular preventers 118 and the rams 120. The operation can control inputs into the well control programmable logic controller 170 and view outputs, status, and conditions of the well control programmable logic controller 170 by the input/output device 172. The well control programmable logic controller 170 performs operations including receiving the signal indicating the value of the conditions of the well system 100 from the sensors 166; comparing the value to a preset value stored in the well control programmable logic controller 170; and in response to the value greater than or equal to the preset value, transmitting a command signal to the subsea blowout preventer control system 128 to seal, by one or more of the annular preventers 118 and the rams 120, the fluid flow through the subsea blowout preventer stack 116. The operations of the well control programmable logic controller 170 are described in detail in reference to FIG. 1C.

The well control programmable logic controller 170 includes a computer. The well control programmable logic controller 170 can be various forms of digital computers, such as printed circuit boards (PCB), processors, digital circuitry, or otherwise parts of a fracture geometry mapping system. Additionally, the system can include portable storage media, such as, Universal Serial Bus (USB) flash drives. For example, the USB flash drives may store operating systems and other applications. The USB flash drives can include input/output components, such as a wireless transmitter or USB connector that may be inserted into a USB port of another computing device.

The well control programmable logic controller 170 can include a processor 174, a memory 176, a storage device 178, and the input/output device 172 can be interconnected using a system bus 180. The processor 174 is capable of processing instructions for execution within the well control programmable logic controller 170. The processor 174 may be designed using any of a number of architectures. For example, the processor may be a CISC (Complex Instruction Set Computers) processor, a RISC (Reduced Instruction Set Computer) processor, or a MISC (Minimal Instruction Set Computer) processor.

In one implementation, the processor 174 is a single-threaded processor. In another implementation, the processor 174 is a multi-threaded processor. The processor 174 is capable of processing instructions stored in the memory 176 or on the storage device to display graphical information for a user interface on the input/output device.

The memory 176 stores information within the well control programmable logic controller 170. In one implementation, the memory 176 is a computer-readable medium. In one implementation, the memory 176 is a volatile memory unit. In another implementation, the memory 176 is a non-volatile memory unit.

The storage device 178 is capable of providing mass storage for the well control programmable logic controller 170. In one implementation, the storage device 178 is a computer-readable medium. In various implementations, the storage device may be a floppy disk device, a hard disk device, an optical disk device, or a tape device.

The input/output device 172 provides input/output operations for the well control programmable logic controller 170. In one implementation, the input/output device 172 includes a keyboard 182 and/or a pointing device 184. In another implementation, the input/output device 172 includes a display device 186 for displaying graphical user interfaces.

The features described in respect to the well control programmable logic controller 170 can be implemented in digital electronic circuitry, or in computer hardware, firmware, software, or in combinations of them. The apparatus can be implemented in a computer program product tangibly embodied in an information carrier, for example, in a machine-readable storage device for execution by a programmable processor; and method steps can be performed by a programmable processor executing a program of instructions to perform functions of the described implementations by operating on input data and generating output. The described features can be implemented advantageously in one or more computer programs that are executable on a programmable system including at least one programmable processor coupled to receive data and instructions from, and to transmit data and instructions to, a data storage system, at least one input device, and at least one output device. A computer program is a set of instructions that can be used, directly or indirectly, in a computer to perform a certain activity or bring about a certain result. A computer program can be written in any form of programming language, including compiled or interpreted languages, and it can be deployed in any form, including as a stand-alone program or as a module, component, subroutine, or other unit suitable for use in a computing environment.

Suitable processors 174 for the execution of a program of instructions include, by way of example, both general and special purpose microprocessors, and the sole processor or one of multiple processors of any kind of computer. Generally, the processor 174 will receive instructions and data from a read-only memory or a random-access memory or both. The essential elements of a computer are a processor for executing instructions and one or more memories for storing instructions and data. Generally, a computer will also include, or be operatively coupled to communicate with, one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD-ROM and DVD-ROM disks. The processor and the memory can be supplemented by, or incorporated in, ASICs (application-specific integrated circuits).

To provide for interaction with a user (the operator), the features can be implemented on a computer having the display device 186 such as a CRT (cathode ray tube) or LCD (liquid crystal display) monitor for displaying information to the user and a keyboard 182 and the pointing device 184 such as a mouse or a trackball by which the user can provide input to the computer. Additionally, such activities can be implemented via touchscreen flat-panel displays and other appropriate mechanisms.

These features can be implemented in a control system that includes a back-end component, such as a data server, or that includes a middleware component, such as an application server or an Internet server, or that includes a front-end component, such as a client computer having a graphical user interface or an Internet browser, or any combination of them. The components of the system can be connected by any form or medium of digital data communication such as a communication network. Examples of communication networks include a local area network ("LAN"), a wide area network ("WAN"), peer-to-peer networks (having ad-hoc or static members), grid computing infrastructures, and the Internet.

Figure 1B:
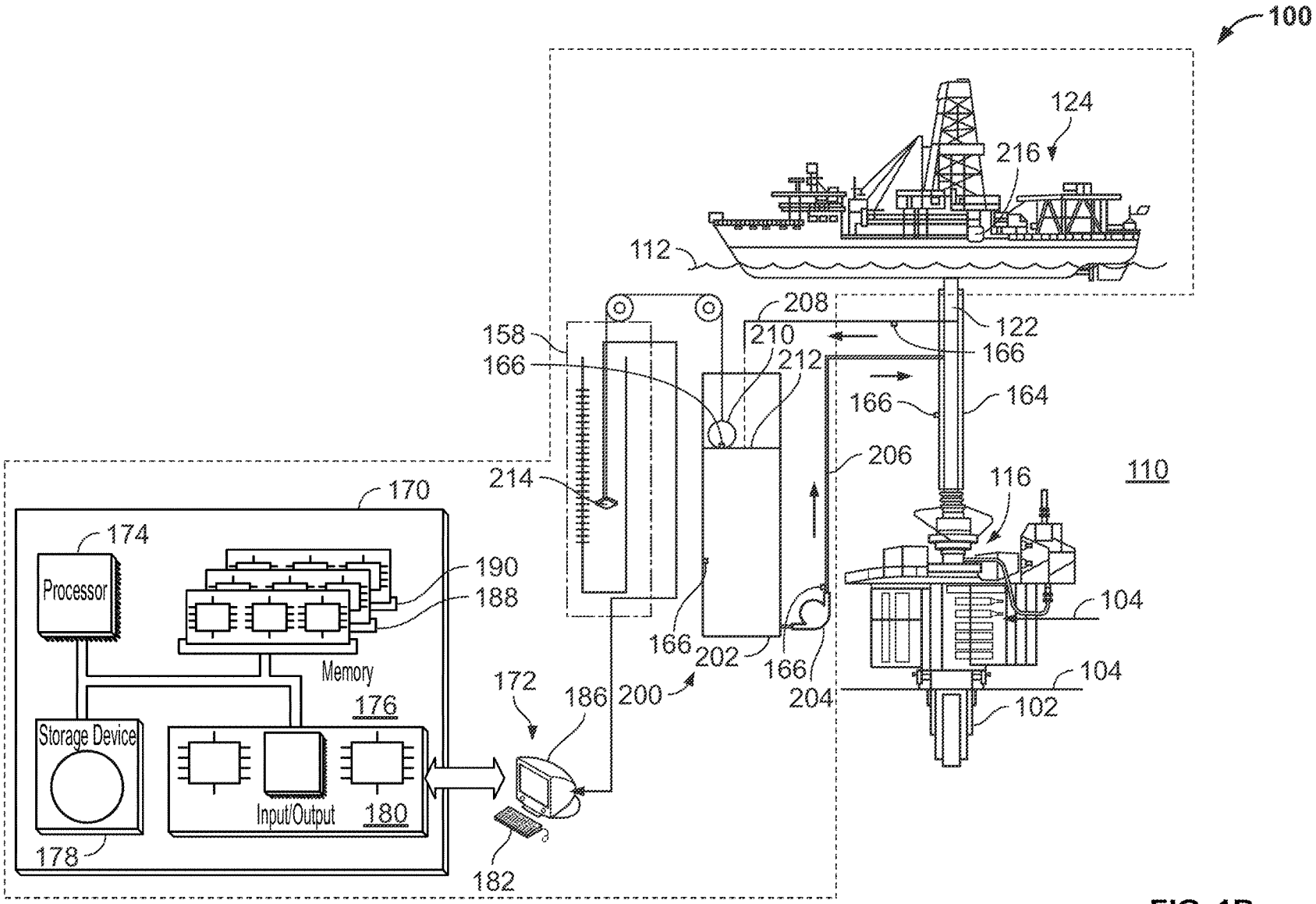
FIG. 1B shows a drilling mud system coupled to the well system of FIG. 1A.

In some implementations, the well control programmable logic controller 170 includes a trip tank 202 volume monitoring module 188, described in detail in reference to FIGS. 1A and 1B. In some implementations, the well control programmable logic controller 170 includes a real time inflow test module 190, described in detail in reference to FIGS. 1A and 1B.

FIG. 1B shows a drilling mud system coupled to the well system of FIG. 1A. The well system 100 includes a drilling mud system 200 positioned in the drill ship 124 and coupled to the riser 164 and the work string 122 to control a flow of drilling mud through the wellbore 102. The drilling mud system 200 has a trip tank 202 containing a volume of the drilling mud. The volume of the drilling mud is tracked during movement of the work string 122. The drilling mud system 200 has a mud tank 216 (also referred to as a mud pit) in the drill ship 124 containing a larger volume of the drilling mud which flows down the work string 122 into the wellbore 102.

The drilling mud system 200 has a trip tank pump 204 positioned in a fill up line 206 (also referred to as a surface line) fluidly coupling the trip tank 202 to the work string 122. The trip tank pump 204 pressurizes and flows the drilling mud from the trip tank 202 to an annulus (not shown) defined by an inner surface the wellbore 120 and the riser 164 and an outer surface of the work string 122. The drilling mud then flows out the work string 122 and through the annulus to a return line 208 which conducts the drilling mud back to the trip tank 202 during movement (tripping) of the work string 122.

The drilling mud system 200 includes a float 210 resting on a surface 212 of the drilling mud in the trip tank 202. The float 210 moves with the surface 212 of the drilling mud. A trip tank level indicator 214 is coupled to the float 210 and displays a trip tank 202 level (or corresponding volume) on the main blowout preventer panel 158.

The drilling mud system 200 includes multiple sensors 166 positioned throughout the drilling mud system 200. The sensors 166 positioned in the drilling mud system 200 transmit signals representing values of the conditions of the drilling mud system 200 to the well control programmable logic controller 170. The conditions of the drilling mud system 200 sensed by the sensors 166 can include one or more of a flow rate of the drilling mud in the surface line 206, a pressure of the drilling mud in the surface line 206, a level of the drilling mud in the mud pit 216, a volume of drilling mud in the mud pit 216, a mud weight of the drilling mud, a level of drilling mud in a trip tank of the mud system, and a volume of drilling mud in the trip tank. The well control programmable logic controller 170 receives the signals representing the values of the conditions of the drilling mud system 200 and performs various operations described in reference to FIG. 1C.

Figure 1C:
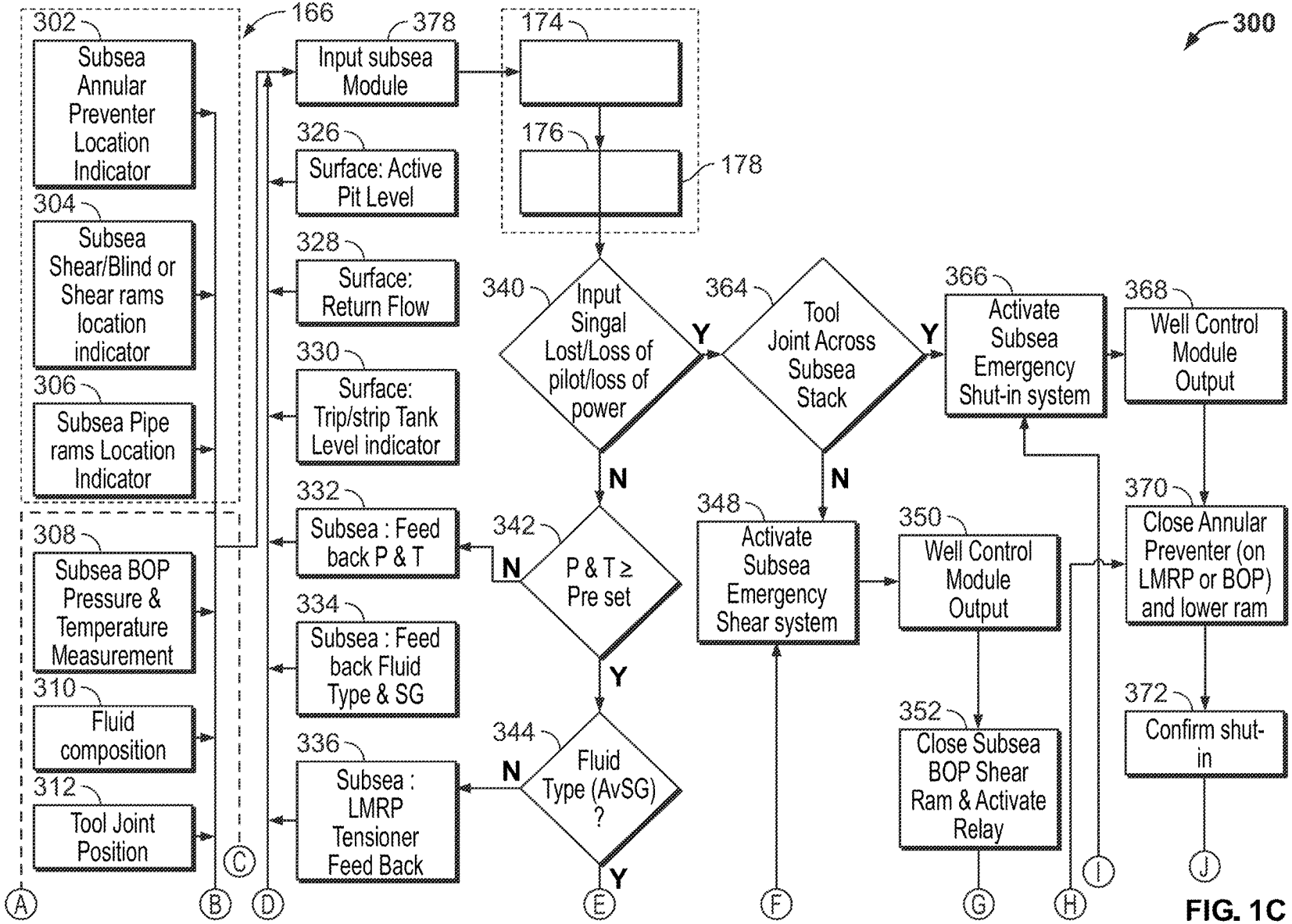
FIG. 1C is module view of a well control programmable logic controller of FIG. 1A.
Figure 1C:
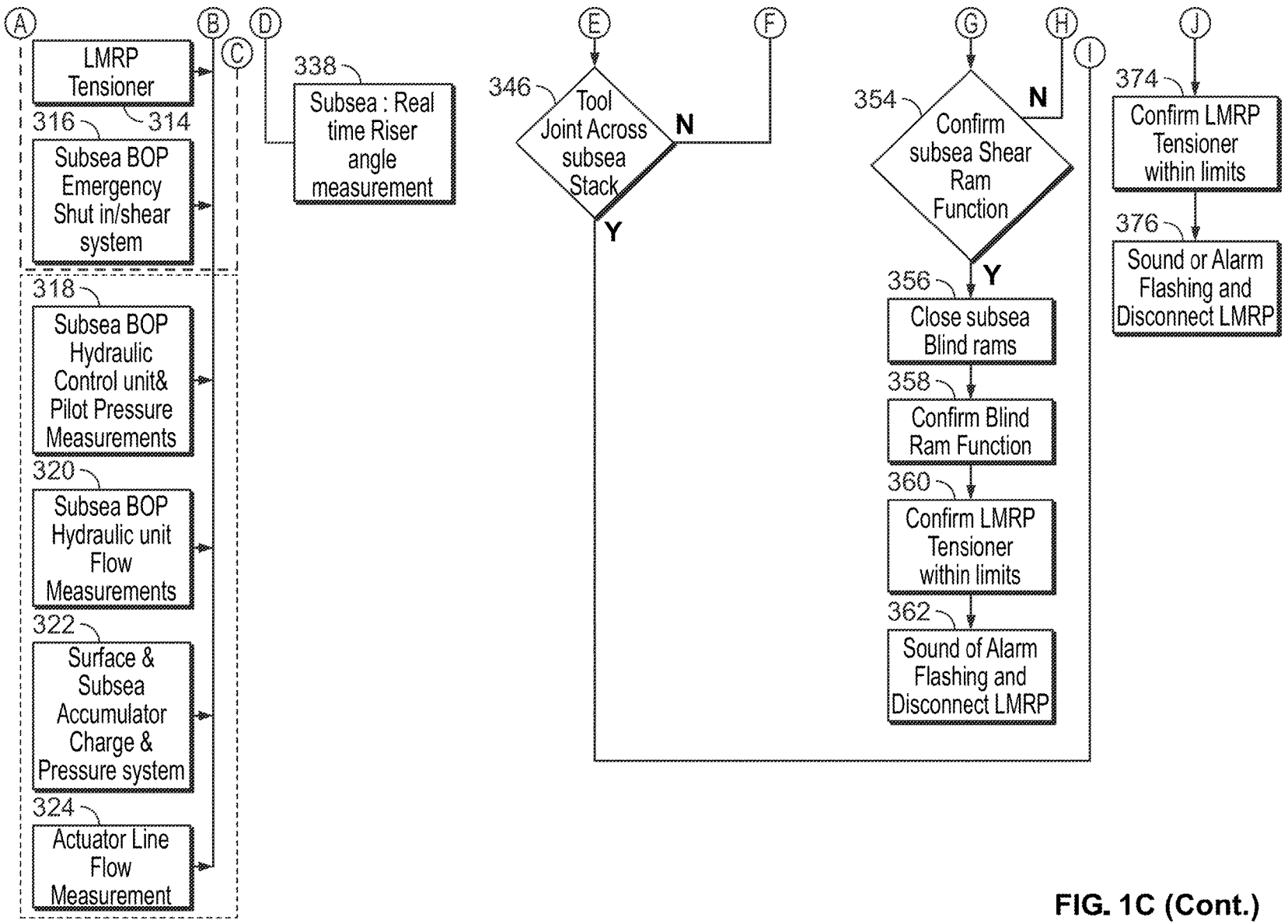

FIG. 1C is module view 300 of the well control programmable logic controller 170 of FIG. 1A. The well control programmable logic controller 170 receives the signals representing the values of the conditions of the well system 100 including the drilling mud system 200 and compares the values to preset values stored in the well control programmable logic controller 170. Based on the result of the comparison, between the sensed values and the preset values, the well control programmable logic controller 170 operates the annular preventer 118 and the rams 120.

The well control programmable logic controller 170 receives the signals representing the values of the conditions of the well system 100 from the sensors 166. The well control programmable logic controller 170 has various modules which store the preset values for each condition, receive the values representing the conditions of the well system 100, compare the values representing the conditions of the well system 100 to the preset values, and based on the result of the comparisons, operate the annular preventer 118 and rams 120. The conditions of the annular preventer 118 and the rams 120 include a subsea annular preventer location indication 302, a subsea shear/blind or shear rams location indication 304, a subsea pipe rams location indication 306, and a subsea blowout preventer pressure & temperature measurement 308. The conditions of the subsea blowout preventer stack 116 include a fluid composition 310 and a tool joint position 312. The conditions of the lower marine riser package 160 include a lower marine riser package tensioner 314 condition. The conditions of the subsea blowout preventer control system 128 include a subsea blowout preventer equipment emergency shut in/shear system status 316, a subsea blowout preventer hydraulic control unit & pilot pressure measurement 318, a subsea blowout preventer hydraulic unit flow measurement 320, a surface & subsea accumulator charge and pressure system status 322, and an actuator line flow measurement 324.

The conditions of the drilling mud system 200 include, at the surface, an active mud pit level 326, a return flow rate 328, and a trip/strip tank level 330. The conditions of the drilling mud system 200 include, at a subsea location, a feedback pressure & temperature 332, and a feedback fluid type and specific gravity 334. The subsea conditions of the well system 100 include a subsea lower marine riser tensioner feedback 336 and a subsea real time riser angle measurement 338.

The values of the conditions 302-338 input into an input subsea module 378 and processes the values. The input subsea module 378 transmits the processed values of the conditions 302-338 to the processor 174 (a central processing unit), the memory 176, and the storage device 178. The processor 174 performs the following functions 340-376 including drift off analysis for the drilling riser 164 system on a mobile drilling unit. The processor 174 can be integrated with a dynamic positioning system on the rig 126 which can evaluate the position of the drill ship 124 under various wind and current speeds, wave heights, and wave periods. The processor 174 can determine the load or stress equivalent of the riser 164 and key riser 164 component real time conditions and make a comparison with preset data in the memory 176. This can ensure a proper stroke-out of the tensioner 162 or telescopic joint, upper flex joint 192 limits and lower flex joints 192 limits, a wellhead connector condition, a lower marine riser package 160 connector (not shown) condition, or the riser 164 joints are all within acceptable limits. However, in some cases, where a limit (a threshold value) is exceeded on any component of the riser 164 system, the processor 174 can calculate ta allowable disconnect offset for the different components and identify a point of disconnect which can correspond to the smallest allowable disconnect for critical components of the riser 164.

At step 340, the processor 174 monitors for an input signal lost or a loss of pilot can include a loss of fluid sent to the pilot valves in the subsea control pods 130*a*, 130*b* for the hydraulic blow out preventer stack control system 128 or in deeper waters where umbilical handling and reaction time would be so large such that it is impractical. The loss of pilot can include a loss of either electric signals which operate solenoid vales and/or loss of hydraulic signal from the solenoid valves to the respective pilot valve in the subsea control pods 130*a*, 130*b*. In some cases, an acoustic system (not shown) is used to control the subsea blow out preventer stack 116 and the loss of pilot can be a loss of acoustic signals. The processor 174 monitors for a loss of power signal. In response to a NO condition at 340, the processor 174 moves to step 342.

At step 342, the processor 174 compares the subsea blowout preventer pressure and temperature measurement 308 to a preset subsea blowout preventer pressure temperature measurement. The processor 174 monitors for a condition where the subsea blowout preventer pressure and temperature measurement 308 is greater than or equal to the preset subsea blowout preventer pressure temperature measurement. In response to the subsea blowout preventer pressure and temperature measurement 308 less than the preset subsea blowout preventer pressure temperature measurement, i.e., a NO condition, the processor 174 provides a feedback adjustment to the subsea feedback pressure & temperature 332 and the functions restart at step 340. In response to the subsea blowout preventer pressure and temperature measurement 308 greater than or equal to the preset subsea blowout preventer pressure temperature measurement, i.e., a YES condition, the processor 174 moves to step 344.

At step 344, the processor 174 compares the fluid composition 310 (i.e., a fluid type by average specific gravity) to a preset value of specific gravity for fluid types. Monitoring the specific gravity can indicate or detect a complete loss of well control where the well has been displaced with an influx or where there is reduced density as a result of the influx. The fluid type and pressure and temperature from step 342 can provide a positive indication of loss of well control. Early intervention can help to prevent the riser 164 from unloading. The processor 174 monitors for a condition where the fluid composition 310 (i.e., specific gravity) is less than the specific gravity preset value (preset gravity includes the mud density and impact of temperature and pressure with a tolerance included). In response to the fluid composition 310 (i.e., specific gravity) equal to or greater than the specific gravity preset value, i.e., a NO condition, the processor 174 provides a feedback adjustment to the subsea feedback fluid type & specific gravity 334 and the functions restart at step 340. In response to the fluid composition 310 (i.e., specific gravity) less than the specific gravity preset value and correlates with fluid type and specific gravity of influx from different horizons as well as the pressure and the temperature greater than or equal to the preset value, and memory 176 includes specific gravity of several combinations of influx and mud up to fully displaced influx for all the exposed producible hydrocarbon intervals and position, i.e., a YES condition, the processor 174 moves to step 346.

At step 346, the processor 174 monitors the tool joint position 312 for a condition where tool joint position 312 is in the subsea blowout preventer stack 116. In response to the tool joint position 312 outside the ram position in the subsea blowout preventer stack 116, i.e., a NO condition, the processor 174 moves to step 348. At step 348, the processor 174 activates the subsea emergency shear system (the rams 120) by sending a signal to the well control module output 350, which, at step 352, closes the subsea blowout preventer shear rams & activates a relay, and moves to step 354.

At step 354, the processor 174 confirms the subsea shear ram function. In response to confirming proper operation and function of the subsea shear ram, i.e. a YES condition, the processor 174 moves to step 356. At step 356, the processor 174 transmits a command signal to close the subsea blind rams and moves to step 358. At step 358, the processor 174 confirms blind ram function and proceeds to step 360. At step 360, the processor 174 confirms lower marine riser package tensioner with limits. For example, the processor 174 can compare the lower marine riser package tensioner 314 between the upper preset value threshold and the lower preset value threshold. In response to the value of the tension of the lower marine riser package tensioner 314 greater than the upper preset value threshold or less than the lower preset value threshold, the processor 174 moves to step 362. At step 362, the processor 174 initiates a sound or flashing light alarm and disconnects the lower marine riser package 160 and the riser 164 from the drill ship 124 and the processor 174 stops.

Returning to step 340, in response to a YES condition at step 340, the processor moves to step 364. At step 364, the processor 174 monitors the tool joint position 312 for a condition where tool joint position 312 is in the subsea blowout preventer stack 116. In response to the tool joint position 312 not within the ram position in the subsea blowout preventer stack 116, i.e., a NO condition, the processor 174 moves to step 348. At step 348, the processor 174 activates the subsea emergency shear system (the rams 120) by sending a signal to the well control module output 350, which, at step 352, closes the subsea blowout preventer rams & activates a relay, and moves to step 354. At step 354, the processor 174 confirms the subsea shear ram function. In response to confirming proper operation and function of the subsea shear ram, the processor 174 moves to step 356. At step 356, the processor 174 transmits a command signal to close the subsea blind rams and moves to step 358. At step 358, the processor 174 confirms blind ram function and proceeds to step 360. At step 360, the processor 174 confirms the lower marine riser package tensioner with limits. For example, the processor 174 can compare the lower marine riser package tensioner 314 between the upper preset value threshold and the lower preset value threshold. In response to the value of the tension of the lower marine riser package tensioner 314 greater than the upper preset value threshold or less than the lower preset value threshold, the processor 174 moves to step 362. At step 362, the processor 174 initiates a sound or flashing light alarm and disconnects the lower marine riser package 160 and the riser 164 from the drill ship 124 and the processor 174 stops.

Returning to step 346 or 364, in response to the tool joint position 312 within the subsea blowout preventer stack 116, i.e., a YES condition, the processor 174 moves to step 366. At step 366, the processor 174 actives a subsea emergency shut-in system and moves to step 368. At step 368, in response to the processor 174 activating the subsea emergency shut-in system, the well control module of the processor 174 generates an output, i.e., the processor 174 transmits a command signal to the annular preventer and a lower ram and moves to step 370.

At step 370, the processor 174 closes the annular preventer on the lower marine riser package 160 or the subsea blowout preventer stack 116 and moves to step 372. At step 372, the processor confirms shut-in of the annular preventer 118 and the lower ram 120 and moves to step 374. At step 374, the processor 174 confirms the lower marine riser package tensioner with limits. For example, the processor 174 can compare the lower marine riser package tensioner 314 between the upper preset value threshold and the lower preset value threshold. In response to the value of the tension of the lower marine riser package tensioner 314 greater than the upper preset value threshold or less than the lower preset value threshold, the processor 174 moves to step 362. At step 362, the processor 174 initiates a sound or flashing light alarm and disconnects the lower marine riser package 160 and the riser 164 from the drill ship 124 and the processor 174 stops.

Returning to step 354, the processor 174 confirms the subsea shear ram function. In response to confirming an improper operation and a dis-function of the subsea shear ram, i.e. a NO condition, the processor 174 moves to step 370. At step 370, the processor 174 closes the annular preventer on the lower marine riser package 160 or the subsea blowout preventer stack 116 and moves to step 372. At step 372, the processor confirms shut-in of the annular preventer 118 and the lower ram 120 and moves to step 374. At step 374, the processor 174 confirms the lower marine riser package tensioner with limits. For example, the processor 174 can compare the lower marine riser package tensioner 314 between the upper preset value threshold and the lower preset value threshold. In response to the value of the tension of the lower marine riser package tensioner 314 greater than the upper preset value threshold or less than the lower preset value threshold, the processor 174 moves to step 362. At step 362, the processor 174 initiates a sound or flashing light alarm and disconnects the lower marine riser package 160 and the riser 164 from the drill ship 124 and the processor 174 stops.

The operation of the rams 120 can be staggered or delayed. A subsea blowout preventer stack 116 and subsea blowout preventer control system 128 can have a delay time controlled by the well control programmable logic controller 170. The delay time is predetermined by the operator. In some cases, the predetermined delay time is twice a response time required to seal the subsea blowout preventer stack 116. In other cases, the predetermine delay time is twice a response time required to activate the at least one ram 120.

The delay time is between the activation of the first ram 120 (a subsea blowout preventer shear ram) and the activation of the second ram 120 (one or more sealing rams). The delay is built into the well control programmable logic controller 170 is based the measurement of the position of a piston of the subsea blowout preventer shear rams 120 when the rams 120 are activated and functioning properly. The logic of the well control programmable logic controller 170 assesses the shear criteria (a shear preset value) programmed in the well control programmable logic controller 170 which monitors the shearing pressure and fluid volume required to shear the work string 122 in the subsea blowout preventer stack 116 and compares with the calculated shear pressure for the work string 122.

The sequence for the secondary seal (another annular preventer 118 or another ram 120) will only be activated after a preset period determined by the operator and programmed in the well control programmable logic controller 170 responsive to the criteria being met and the location sensor 166 on the shear rams 120 confirms full stroke of the shear ram piston (i.e. full tubular shear). Responsive to full stroke of the shear ram piston is not confirmed, the sealing ram 120 will not be activated. When the sealing ram 120 is activated, the well control programmable logic controller 170 monitors the function of the ram 120 and confirms that the wellbore 102 is effectively sealed.

In some implementations, referring to FIGS. 1A and 1B, the well control programmable logic controller 170 includes the trip tank 202 volume monitoring module 188. The well control programmable logic controller 170 monitors of the volume of the trip tank 202 with the calibrated trip tank level indicator 214 and output display on main blowout preventer panel 158. For example, the trip tank level indicator 214 can show the level of the trip tank 202 relative to time during a flow check operation. The well control programmable logic controller 170 can detect any change in trip tank 202 volume by comparing the trip tank 202 volume or level to a trip tank 202 threshold volume or threshold level during the period of the flow check operation and send a signal to the main blowout preventer panel 158 which could be electric, hydraulic, pneumatic or a combination, signifying a positive indication of inflow (kick) into the wellbore 102. The well control programmable logic controller 170 can detect the change in trip tank 202 volume or level during tripping operations. The well control programmable logic controller 170 can also provide positive indication of a swabbed in kick condition where the volume of a steel displacement being less than a calculated displacement while pulling the work string 122 out of the wellbore 102 or where the volume of displacement is greater than the steel displacement while tripping the work string 122 into the wellbore 102. The well control programmable logic controller 170 can calculate the displacement volumes based on a bottom hole assembly configuration of the work string 122.

In some implementations, referring to FIGS. 1A and 1B, the well control programmable logic controller 170 includes a real time inflow test module 190. An inflow test can be conducted on the wellbore 102 by the well control programmable logic controller 170 by reducing a pressure of the subsea well control system, monitoring a flow rate from the subsea well control system, adjusting the flow rate for temperature effects, comparing the adjusted flow rate to a zero leak rate, and based on the result of the comparison, in response to the adjusted flow rate is great than or equal to the zero leak rate, determining that an inflow condition exists. The flow rate can be adjusted for temperature affects by an algorithm like the Horner Time to evaluate the test data to ensure it complies with the zero-leak-rate criteria. In some wellbores 102 which are high pressure high temperature wellbores, the real time inflow test module 190 can further identify and distinguish in real-time between fluid expansion due to temperature effects and actual formation fluid influx and detect wellbore 102 ballooning effects when drilling with mud weights close to a fracture gradient threshold.

Figure 2:
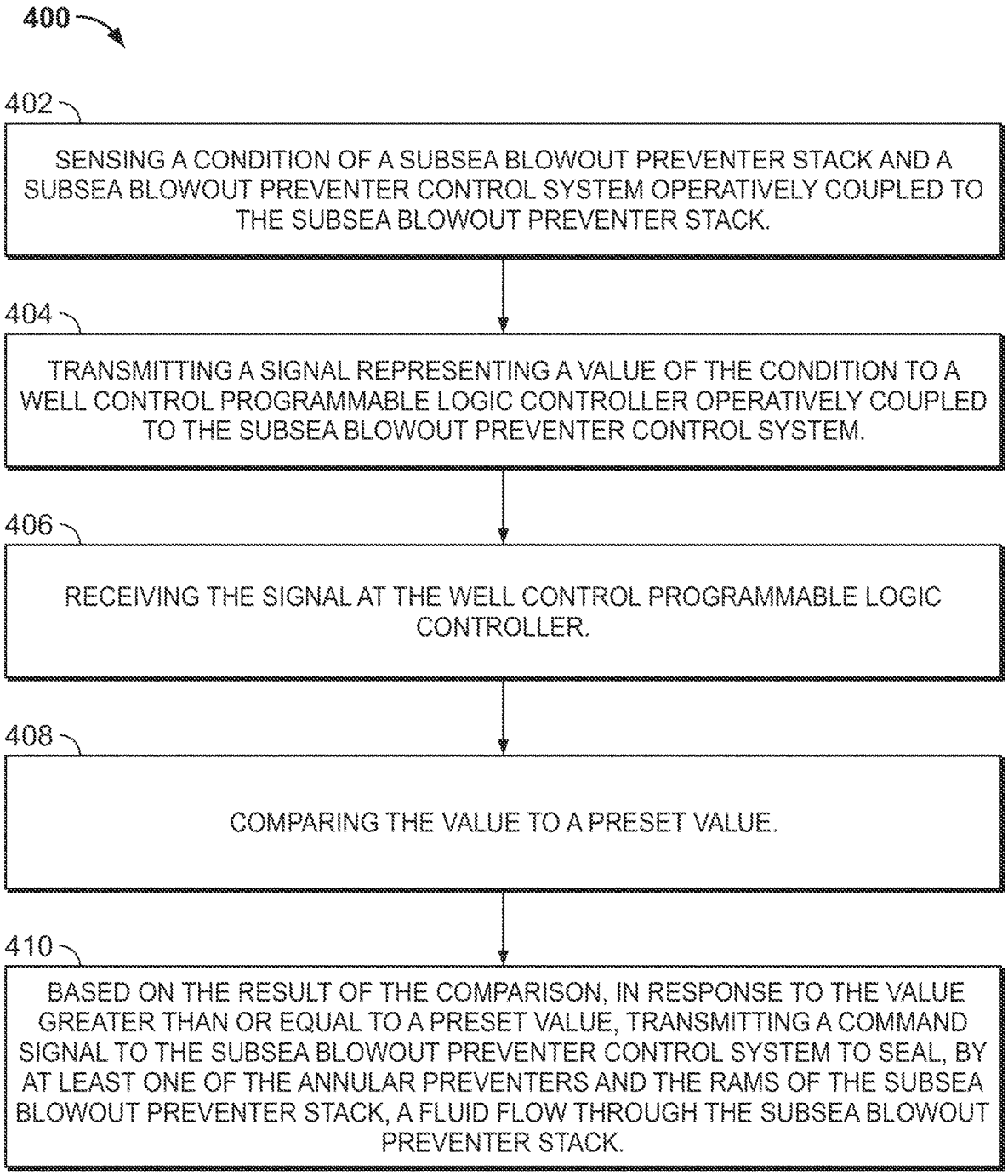
FIG. 2 is a flow chart of an example method of controlling a subsea blowout preventer stack.

FIG. 2 is a flow chart 400 of an example method of controlling a subsea blowout preventer stack. At 402, a condition of a subsea blowout preventer stack and a subsea blowout preventer control system operatively coupled to the subsea blowout preventer stack is sensed. The condition can be at least one of a temperature, a pressure, a fluid type of a fluid in the subsea blowout preventer stack, a specific gravity of the fluid in the subsea blowout preventer stack, a flow rate in the subsea blowout preventer stack, a presence of a tool joint of a work string, a location of one or more annular preventers, a location of one or more rams, a position of the annular preventers, a position of the rams, a wear measurement of the annular preventers, a wear measurement of the rams, a closure blockage of at least one of the annular preventers or the rams, or a pressure of the subsea blowout preventer control system. For example, referring to FIG. 1A, the conditions of the subsea blowout preventer stack 116 including the annular preventers 118 and the rams 120 can be is sensed.

At 404, a signal representing a value of the condition is transmitted to a well control programmable logic controller operatively coupled to the subsea blowout preventer control system. For example, referring to FIG. 1A, the sensors 166 transmit the values representing the conditions of the subsea blowout preventer stack 116 including the annular preventers 118 and the rams 120 are transmitted to the well control programmable logic controller 170. The well control programmable logic controller 170 operates the subsea blowout preventer control system 128.

At 406, the signal is received at the well control programmable logic controller. For example, referring to FIG. 1A, the well control programmable logic controller 170 receives the signals from the sensors 166.

At 408, the value is compared to a preset value. For example, referring to FIG. 1C, the well control programmable logic controller 170 can compare the signals representing the conditions 302-332 are compared in steps 340-346, 354, 358, 364, and 372-374.

At 410, based on the result of the comparison, in response to the value greater than or equal to a preset value, a command signal is transmitted to the subsea blowout preventer control system to seal, by at least one of the annular preventers and the rams of the subsea blowout preventer stack, a fluid flow through the subsea blowout preventer stack. For example, referring to FIG. 1C, the well control programmable logic controller 170 can transmit signals at steps 350 and 368.

In some implementations, sealing the fluid flow through the subsea blowout preventer stack includes activating at least one ram to seal the subsea blowout preventer stack; after activating the ram, waiting a predetermined delay time; and after waiting the predetermined delay time, activating another ram or an annular preventer to further seal the subsea blowout preventer stack. In some cases, the predetermined delay time is twice a response time required to seal the subsea blowout preventer stack. In some cases, the predetermine delay time is twice a response time required to activate one ram. For example, the well control programmable logic controller 170 can operate the annular preventers 118 and the rams 120 with a delay time.

In some implementations, sealing the fluid flow through the subsea blowout preventer stack includes monitoring i) a shearing pressure of the ram, ii) a fluid volume required to shear the work string by the ram, and iii) a position of a shear ram piston of the ram. The method can include comparing the shearing pressure to a calculated shear pressure for the work string. The shearing pressure being greater than or equal to the calculated shear pressure indicates proper operation of the ram. The method includes comparing the fluid volume required to shear the work string to a calculated fluid volume required to shear the work string. The fluid volume required to shear the work string being greater than or equal to the calculated fluid volume indicates proper operation of the ram. The method includes detecting the position of the shear ram piston at a full stroke position indicating a full tubular shear of the work string. The method includes in response to i) the shearing pressure greater than or equal to the calculated shear pressure, ii) the fluid volume required to shear the work string greater than or equal to the calculated fluid volume, and iii) the position of the shear ram piston is at the full stroke position, waiting the predetermined delay time. The method includes after waiting the predetermined delay time, activating another ram to further seal the subsea blowout preventer stack. For example, the rams 120 can be operated with a delay time to verify proper operation as described in reference to FIG. 1C, steps 354, 358, and 370.

In some implementations, the method further includes receiving, from lower marine riser package sensors coupled to a lower marine riser package, where the lower marine riser package is coupled to and positioned about the subsea blowout preventer stack, a signal representing a value of a condition of the lower marine riser package. The condition can include at least one of a loss of power to the lower marine riser package, a signal to the emergency disconnect package to disconnect or latch, a loss of signal to pilot valves of the lower marine riser package, a loss of dynamic positioning, loss of hydraulic pressure to subsea control pods, a drift off, a drive off, a collision with the supply vessel, an electronic riser angle exceeding a maximum design rating triggering the lower marine riser package to disconnect from the subsea blowout preventer stack. The method can include comparing the value to a lower marine riser package and/or riser preset values. The method can include, based on the result of the comparison, in response to the value greater than or equal to a preset value, transmitting the command signal to the subsea blowout preventer control system to seal, by an annular preventer and rams of the subsea blowout preventer stack, a fluid flow through the subsea blowout preventer stack. In some cases, the method can further include adjusting a value of a tension of tensioners coupling the lower marine riser package to the subsea blowout preventer stack within an upper tension limit and a lower tension limit. For example, the tension in tensioners 162 can be monitored and adjusted by the subsea blowout preventer control system 128.

In some implementations, the method further includes receiving, at the well control programmable logic controller, a signal representing a value of a condition of a mud system. The mud system flows a drilling mud to the subsea blowout preventer stack. The condition of the mud system can be at least one of a flow rate of the drilling mud in a surface line of the mud system, a pressure of the drilling mud in the surface line of the mud system, a level of the drilling mud in a mud pit of the mud system, a volume of drilling mud in the mud pit, a mud weight of the drilling mud, a level of drilling mud in a trip tank of the mud system, and a volume of drilling mud in the trip tank. The method can include comparing the value of the condition of the mud system to a mud system preset value. The method can include in response to the value greater than or equal to a corresponding mud system preset value, transmitting the command signal to the subsea blowout preventer control system to seal, by at the annular preventers and the rams of the subsea blowout preventer stack, a fluid flow through the subsea blowout preventer stack. For example, the trip tank 202 volume monitoring module 188 monitors of the volume of the trip tank 202 with the calibrated trip tank level indicator 214 with and output display on main blowout preventer panel 158.

In some implementations, the method further includes, by the well control programmable logic controller, reducing a pressure of the subsea well control system; monitoring a flow rate from the subsea well control system; adjusting the flow rate for temperature effects; comparing the adjusted flow rate to a zero leak rate; and based on the result of the comparison, in response to the adjusted flow rate is great than or equal to the zero leak rate, determining that an inflow condition exists. For example, the real time inflow test module 190 can perform the inflow test on the wellbore 102 by monitoring the flow rate from the subsea well control system, adjusting the flow rate for temperature effects, comparing the adjusted flow rate to a zero leak rate, and based on the result of the comparison, in response to the adjusted flow rate is great than or equal to the zero leak rate, determine that the inflow condition exists.

In some implementations, the method further includes receiving, at the well control programmable logic controller, a control signal from an offsite real-time operations center; and transmitting, to the offsite real-time operations center and from the well control programmable logic controller, a status signal indicating the condition of the subsea well control system. For example, the well control programmable logic controller 170 can transmit status signals to and receive command signals from an offsite real-time operations center.

Although the following detailed description contains many specific details for purposes of illustration, it is understood that one of ordinary skill in the art will appreciate that many examples, variations, and alterations to the following details are within the scope and spirit of the disclosure. Accordingly, the example implementations described herein and provided in the appended figures are set forth without any loss of generality, and without imposing limitations on the claimed implementations.

The invention claimed is:

1. A subsea well control system comprising:

a plurality of subsea blowout preventer stack sensors coupled to a subsea blowout preventer stack and a subsea blowout preventer control system, the subsea blowout preventer control system operatively coupled to the subsea blowout preventer stack, the plurality of subsea blowout preventer stack sensors configured to:

sense a condition of the subsea blowout preventer stack and the subsea blowout preventer control system, the condition comprising at least one of a temperature, a pressure, a fluid type of a fluid in the subsea blowout preventer stack, a specific gravity of the fluid, a flow rate of the fluid, a presence of a tool joint of a work string, a location of a plurality of annular preventers, a location of a plurality of rams, a position of the plurality of annular preventers, a position of the plurality of rams, a wear measurement of the plurality of annular preventers, a wear measurement of the plurality of rams, a closure blockage of at least one of the plurality of annular preventers or the plurality of rams, or a pressure of the subsea blowout preventer control system; and transmit a signal representing a value of the condition of the subsea blowout preventer stack and the subsea blowout preventer control system; and a well control programmable logic controller operatively coupled to the subsea blowout preventer control system, the well control programmable logic controller configured to perform operations comprising:

receiving the signal representing the value of the condition of the subsea blowout preventer stack and the subsea blowout preventer control system from the plurality of subsea blowout preventer stack sensors;

comparing the value of the condition of the subsea blowout preventer stack and the subsea blowout preventer control system to a subsea blowout preventer stack and subsea blowout preventer control system preset value; and in response to the value of the condition of the subsea blowout preventer stack and the subsea blowout preventer control system greater than or equal to the subsea blowout preventer stack and subsea blowout preventer control system preset value, transmitting a command signal to the subsea blowout preventer control system to seal, by at least one of the plurality of annular preventers and the plurality of rams of the subsea blowout preventer stack, a fluid flow through the subsea blowout preventer stack, wherein sealing the fluid flow through the subsea blowout preventer stack comprises:

activating at least one ram of the plurality of rams to seal the subsea blowout preventer stack;

after activating the at least one ram of the plurality of rams, waiting a predetermined delay time; and after waiting the predetermined delay time, activating another of the plurality of rams or the plurality of annular preventers to further seal the subsea blowout preventer stack.

2. The subsea well control system of claim 1, wherein the plurality of rams comprises one or more of a pipe ram, a variable ram, a shear ram, a blind shear ram, or a casing ram.

3. The subsea well control system of claim 2, wherein the position of the plurality of rams comprises:

an open position permitting the work string to pass through the subsea blowout preventer stack; and a closed position sealing the subsea blowout preventer stack, wherein moving from the open position to the closed position with the work string positioned in the subsea blowout preventer stack shears the work string.

4. The subsea well control system of claim 1, wherein the predetermined delay time is twice a response time required to seal the subsea blowout preventer stack.

5. The subsea well control system of claim 1, wherein the predetermined delay time is twice a response time required to activate the at least one ram of the plurality of rams.

6. The subsea well control system of claim 4, wherein sealing the fluid flow through the subsea blowout preventer stack comprises:

monitoring i) a shearing pressure of the at least one ram of the plurality of rams, ii) a fluid volume required to shear the work string by the at least one ram of the plurality of rams, and iii) a position of a shear ram piston of the at least one ram of the plurality of rams;

comparing the shearing pressure to a calculated shear pressure for the work string, wherein the shearing pressure greater than or equal to the calculated shear pressure indicates proper operation of the at least one ram of the plurality of rams;

comparing the fluid volume required to shear the work string to a calculated fluid volume required to shear the work string, wherein the fluid volume required to shear the work string greater than or equal to the calculated fluid volume indicates proper operation of the at least one ram of the plurality of rams;

detecting the position of the shear ram piston at a full stroke position indicating a full tubular shear of the work string;

in response to i) the shearing pressure greater than or equal to the calculated shear pressure, ii) the fluid volume required to shear the work string greater than or equal to the calculated fluid volume, and iii) the position of the shear ram piston is at the full stroke position, waiting the predetermined delay time; and after waiting the predetermined delay time, activating the another ram of the plurality of rams to further seal the subsea blowout preventer stack.

7. The subsea well control system of claim 1, wherein at least one of the plurality of subsea blowout preventer stack sensors is a solid state magnetic field sensor, a Hall effect sensor, a strain gauge, or a proximity sensor configured to sense a position of a plurality of piston rods, each of the plurality of piston rods coupled to one of the plurality of rams.

8. The subsea well control system of claim 1, wherein the well control programmable logic controller further comprises an alarm configured to alert an operator of the condition of the subsea blowout preventer stack, wherein the alarm comprises at least one of a sounding alarm, a flashing light, or a speed dial call to the operator.

9. The subsea well control system of claim 1, wherein the well control programmable logic controller is operatively coupled to a lower marine riser package coupled to and positioned about the subsea blowout preventer stack, the well control programmable logic controller is further configured to perform operations comprising:

receiving, from a plurality of lower marine riser package sensors, a signal representing a value of a condition of the lower marine riser package, the condition of the lower marine riser package comprising at least one of a loss of power to the lower marine riser package, a loss of signal to a plurality of pilot valves of the lower marine riser package, a loss of dynamic positioning, loss of hydraulic pressure to a plurality of subsea control pods, a drift off, a drive off, a collision with a supply vessel, an electronic riser angle exceeding a maximum design rating triggering the lower marine riser package to disconnect from the subsea blowout preventer stack;

comparing the value of the condition of the lower marine riser package to a lower marine riser package preset value; and in response to the value of the condition of the lower marine riser package greater than or equal to a lower marine riser package preset value, transmitting the command signal to the subsea blowout preventer control system to seal, by at least one of the plurality of annular preventers and the plurality of rams of the subsea blowout preventer stack, a fluid flow through the subsea blowout preventer stack.

10. The subsea well control system of claim 1, wherein the well control programmable logic controller is operatively coupled to a mud system configured to flow a drilling mud to the subsea blowout preventer stack, the well control programmable logic controller is further configured to perform operations comprising:

receiving a signal representing a value of a condition of the mud system, the condition of the mud system comprising at least one of a flow rate of the drilling mud in a surface line of the mud system, a pressure of the drilling mud in the surface line of the mud system, a level of the drilling mud in a mud pit of the mud system, a volume of drilling mud in the mud pit, a mud weight of the drilling mud, a level of drilling mud in a trip tank of the mud system, and a volume of drilling mud in the trip tank;

comparing the value of the condition of the mud system to a mud system preset value; and based on the result of the comparison, in response to the value of the condition of the mud system greater than or equal to the mud system preset value, transmitting the command signal to the subsea blowout preventer control system to seal, by at least one of the plurality of annular preventers and the plurality of rams of the subsea blowout preventer stack, a fluid flow through the subsea blowout preventer stack.

11. The subsea well control system of claim 1, wherein the well control programmable logic controller is further configured to perform inflow test operations comprising:

reducing a pressure of the subsea well control system;

monitoring a flow rate from the subsea well control system;

adjusting the flow rate for temperature effects;

comparing the adjusted flow rate to a zero leak rate; and based on the result of the comparison, in response to the adjusted flow rate greater than or equal to the zero leak rate, determining that an inflow condition exists.

12. The subsea well control system of claim 1, wherein the well control programmable logic controller is further configured to receive command signals from and transmit status signals to an offsite real-time operations center.

13. A subsea well control system comprising:

a plurality of blowout preventer stack sensors coupled to a subsea blowout preventer stack and a subsea blowout preventer control system, the subsea blowout preventer control system operatively coupled to the subsea blowout preventer stack, the plurality of blowout preventer stack sensors configured to:

sense a condition of the subsea blowout preventer stack and the subsea blowout preventer control system, the condition of the subsea blowout preventer stack and the subsea blowout preventer control system comprising at least one of a temperature, a pressure, a fluid type of a fluid in the subsea blowout preventer stack, a specific gravity of the fluid, a flow rate of the fluid, a presence of a tool joint of a work string, a location of a plurality of annular preventers, a location of a plurality of rams, a position of the plurality of annular preventers, a position of the plurality of rams, a wear measurement of the plurality of annular preventers, a wear measurement of the plurality of rams, a closure blockage of at least one of the plurality of annular preventers or the plurality of rams, or a pressure of the subsea blowout preventer control system; and transmit a signal representing a value of the condition of the subsea blowout preventer stack and the subsea blowout preventer control system;

a plurality of lower marine riser package sensors coupled to a lower marine riser package, the lower marine riser package coupled to and positioned about the subsea blowout preventer stack, the plurality of lower marine riser package sensors configured to:

sense a condition of the lower marine riser package, the condition of the lower marine riser package comprising at least one of a loss of power to the lower marine riser package, a loss of signal to a plurality of pilot valves of the lower marine riser package, a loss of dynamic positioning, loss of hydraulic pressure to a plurality of subsea control pods, a drift off, a drive off, a collision with a supply vessel, an electronic riser angle exceeding a maximum design rating triggering the lower marine riser package to disconnect from the subsea blowout preventer stack; and transmit a signal representing a value of the condition of the lower marine riser package; and a well control programmable logic controller operatively coupled to the subsea blowout preventer control system and the lower marine riser package, the well control programmable logic controller configured to perform operations comprising:

receiving the signal representing the value of the condition of the subsea blowout preventer stack and the subsea blowout preventer control system from the plurality of blowout preventer stack sensors;

comparing the value of the condition of the subsea blowout preventer stack and the subsea blowout preventer control system from the plurality of blowout preventer stack sensors to a preset value;

receiving, from the plurality of lower marine riser package sensors, the signal representing the value of a condition of the lower marine riser package;

comparing the value of the condition of the lower marine riser package to a lower marine riser package preset value; and in response to the value of the condition of the condition of the subsea blowout preventer stack and the subsea blowout preventer control system greater than or equal to the subsea blowout preventer stack and subsea blowout preventer control system preset value or the value of the condition of the lower marine riser package greater than or equal to the lower marine riser package preset value, transmitting a command signal to the subsea blowout preventer control system to seal, by at least one of the plurality of annular preventers and the plurality of rams of the subsea blowout preventer stack, a fluid flow through the subsea blowout preventer stack, wherein the lower marine riser package comprises a plurality of tensioners coupling the lower marine riser package to the subsea blowout preventer stack, the well control programmable logic controller is further configured to adjust a value of a tension of the plurality of tensioners within an upper tension limit and a lower tension limit.

14. The subsea well control system of claim 13, wherein:

the lower marine riser package is coupled to a riser connected to a drill ship, the riser comprising a plurality of flex joints including at least one of an upper flex joint or a lower flex joint;

a plurality of flex joint sensors coupled to the plurality of flex joints; and the well control programmable logic controller is operatively coupled to the plurality of flex joints, the well control programmable logic controller is further configured to perform operations comprising:

receiving, from the plurality of flex joint sensors, a signal representing a value of a condition of the plurality of flex joints and a critical riser component, the condition of the plurality of flex joints and the critical riser component comprising at least one of an electronic riser angle exceeding a maximum design rating of the riser, an angle of the riser relative to the drill ship, an angle of the riser relative to the lower marine riser package, and an angle of the critical riser component;

comparing the value of the condition of the plurality of flex joints and the critical riser component to a flex joint preset value and a critical riser component preset value; and in response to the value of the condition of the plurality of flex joints and the critical riser component greater than or equal to the flex joints and the critical riser component preset value, transmitting the command signal to the subsea blowout preventer control system to activate a disconnect of an emergency disconnect package from the lower marine riser package.

15. A method comprising:

sensing a condition of a subsea blowout preventer stack and a subsea blowout preventer control system operatively coupled to the subsea blowout preventer stack, the condition comprising at least one of a temperature, a pressure, a fluid type of a fluid in the subsea blowout preventer stack, a specific gravity of the fluid in the subsea blowout preventer stack, a flow rate in the subsea blowout preventer stack, a presence of a tool joint of a work string, a location of a plurality of annular preventers, a location of a plurality of rams, a position of the plurality of annular preventers, a position of the plurality of rams, a wear measurement of the plurality of annular preventers, a wear measurement of the plurality of rams, a closure blockage of at least one of the plurality of annular preventers or the plurality of rams, or a pressure of the subsea blowout preventer control system;

transmitting a signal representing a value of the condition of the subsea blowout preventer stack and the subsea blowout preventer control system to a well control programmable logic controller operatively coupled to the subsea blowout preventer control system;

receiving the signal representing the value of the condition at the well control programmable logic controller;

comparing the value of the condition of the subsea blowout preventer stack and the subsea blowout preventer control system to a subsea blowout preventer stack and subsea blowout preventer control system preset value; and based on the result of the comparison, in response to the value of the condition of the subsea blowout preventer stack and the subsea blowout preventer control system greater than or equal to the subsea blowout preventer stack and subsea blowout preventer control system preset value, transmitting a command signal to the subsea blowout preventer control system to seal, by at least one of the plurality of annular preventers and the plurality of rams of the subsea blowout preventer stack, a fluid flow through the subsea blowout preventer stack, wherein sealing the fluid flow through the subsea blowout preventer stack comprises:

activating at least one ram of the plurality of rams to seal the subsea blowout preventer stack;

after activating the at least one ram of the plurality of rams, waiting a predetermined delay time; and after waiting the predetermined delay time, activating another of the plurality of rams or the plurality of annular preventers to further seal the subsea blowout preventer stack.

16. The method of claim 15, wherein the predetermined delay time is twice a response time required to seal the subsea blowout preventer stack.

17. The method of claim 15, wherein the predetermine delay time is twice a response time required to activate the at least one ram of the plurality of rams.

18. The method of claim 15, wherein sealing the fluid flow through the subsea blowout preventer stack comprises:

monitoring i) a shearing pressure of the at least one ram of the plurality of rams, ii) a fluid volume required to shear the work string by the at least one ram of the plurality of rams, and iii) a position of a shear ram piston of the at least one ram of the plurality of rams;

comparing the shearing pressure to a calculated shear pressure for the work string, wherein the shearing pressure greater than or equal to the calculated shear pressure indicates proper operation of the at least one ram of the plurality of rams;

comparing the fluid volume required to shear the work string to a calculated fluid volume required to shear the work string, wherein the fluid volume required to shear the work string greater than or equal to the calculated fluid volume indicates proper operation of the at least one ram of the plurality of rams;

detecting the position of the shear ram piston at a full stroke position indicating a full tubular shear of the work string;

in response to i) the shearing pressure greater than or equal to the calculated shear pressure, ii) the fluid volume required to shear the work string greater than or equal to the calculated fluid volume, and iii) the position of the shear ram piston is at the full stroke position, waiting the predetermined delay time; and after waiting the predetermined delay time, activating the another ram of the plurality of rams to further seal the subsea blowout preventer stack.

19. The method of claim 15, further comprising:

receiving, from a plurality of lower marine riser package sensors coupled to a lower marine riser package, the lower marine riser package coupled to and positioned about the subsea blowout preventer stack, a signal representing a value of a condition of the lower marine riser package, the condition of the condition of the lower marine riser package comprising at least one of a loss of power to the lower marine riser package, a loss of signal to a plurality of pilot valves of the lower marine riser package, a loss of dynamic positioning, loss of hydraulic pressure to a plurality of subsea control pods, a drift off, a drive off, a collision with a supply vessel, an electronic riser angle exceeding a maximum design rating triggering the lower marine riser package to disconnect from the subsea blowout preventer stack;

comparing the value of the condition of the lower marine riser package to a lower marine riser package preset value; and based on the result of the comparison, in response to the value of the condition of the lower marine riser package greater than or equal to the lower marine riser package preset value, transmitting the command signal to the subsea blowout preventer control system to seal, by at least one of the plurality of annular preventers and the plurality of rams of the subsea blowout preventer stack, a fluid flow through the subsea blowout preventer stack.

20. The method of claim 15, further comprising:

receiving, at the well control programmable logic controller, a signal representing a value of a condition of a mud system configured to flow a drilling mud to the subsea blowout preventer stack, the condition of the mud system comprising at least one of a flow rate of the drilling mud in a surface line of the mud system, a pressure of the drilling mud in the surface line of the mud system, a level of the drilling mud in a mud pit of the mud system, a volume of drilling mud in the mud pit, a mud weight of the drilling mud, a level of drilling mud in a trip tank of the mud system, and a volume of drilling mud in the trip tank;

comparing the value of the condition of the mud system to a mud system preset value; and in response to the value greater than or equal to a corresponding mud system preset value, transmitting the command signal to the subsea blowout preventer control system to seal, by at least one of the plurality of annular preventers and the plurality of rams of the subsea blowout preventer stack, a fluid flow through the subsea blowout preventer stack.

21. The method of claim 15, further comprising:

reducing a pressure of the subsea blowout preventer stack;

monitoring a flow rate from the subsea blowout preventer stack;

adjusting the flow rate for temperature effects;

comparing the adjusted flow rate to a zero leak rate; and based on the result of the comparison, in response to the adjusted flow rate is great than or equal to the zero leak rate, determining that an inflow condition exists.

22. The method of claim 15, further comprising:

receiving, at the well control programmable logic controller, a control signal from an offsite real-time operations center; and transmitting, to the offsite real-time operations center and from the well control programmable logic controller, a status signal indicating the condition of the subsea blowout preventer stack.

23. A method comprising:

sensing a condition of a subsea blowout preventer stack and a subsea blowout preventer control system operatively coupled to the subsea blowout preventer stack, the condition of the subsea blowout preventer stack and the subsea blowout preventer control system comprising at least one of a temperature, a pressure, a fluid type of a fluid in the subsea blowout preventer stack, a specific gravity of the fluid in the subsea blowout preventer stack, a flow rate in the subsea blowout preventer stack, a presence of a tool joint of a work string, a location of a plurality of annular preventers, a location of a plurality of rams, a position of the plurality of annular preventers, a position of the plurality of rams, a wear measurement of the plurality of annular preventers, a wear measurement of the plurality of rams, a closure blockage of at least one of the plurality of annular preventers or the plurality of rams, or a pressure of the subsea blowout preventer control system;

transmitting a signal representing a value of the condition of the subsea blowout preventer stack and the subsea blowout preventer control system to a well control programmable logic controller operatively coupled to the subsea blowout preventer control system;

receiving the signal representing the value of the condition of the subsea blowout preventer stack and the subsea blowout preventer control system at the well control programmable logic controller;

comparing the value of the condition of the subsea blowout preventer stack and the subsea blowout preventer control system to a subsea blowout preventer stack and subsea blowout preventer control system preset value;

receiving, from a plurality of lower marine riser package sensors, the lower marine riser package coupled to and positioned about the subsea blowout preventer stack, a signal representing a value of a condition of the lower marine riser package, the condition of the lower marine riser package comprising at least one of a loss of power to the lower marine riser package, a loss of signal to a plurality of pilot valves of the lower marine riser package, a loss of dynamic positioning, loss of hydraulic pressure to a plurality of subsea control pods, a drift off, a drive off, a collision with a supply vessel, an electronic riser angle exceeding a maximum design rating triggering the lower marine riser package to disconnect from the subsea blowout preventer stack;

comparing the value of the condition of the lower marine riser package to a lower marine riser package preset value; and based on the result of the comparison, in response to the value of the condition of the subsea blowout preventer stack greater than or equal to a subsea blowout preventer stack preset value or the value of the lower marine riser package greater than or equal to the lower marine riser package preset value, transmitting a command signal to the subsea blowout preventer control system to seal, by at least one of the plurality of annular preventers and the plurality of rams of the subsea blowout preventer stack, a fluid flow through the subsea blowout preventer stack and adjusting a value of a tension of a plurality of tensioners coupling the lower marine riser package to the subsea blowout preventer stack within an upper tension limit and a lower tension limit.

* * * * *